US008096645B2

(12) United States Patent
Osawa et al.

(10) Patent No.: US 8,096,645 B2
(45) Date of Patent: Jan. 17, 2012

(54) INSTALLING FLUID CONTAINER IN FLUID EJECTION DEVICE

(75) Inventors: Tatsuro Osawa, Shiojiri (JP); Hiroyuki Sugimoto, Matsumoto (JP); Etsuo Tsuji, Matsumoto (JP); Masayuki Horikawa, Matsumoto (JP); Tsutomu Yamamoto, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/093,303

(22) Filed: Apr. 25, 2011

(65) Prior Publication Data

US 2011/0199443 A1 Aug. 18, 2011

Related U.S. Application Data

(63) Continuation of application No. 12/142,529, filed on Jun. 19, 2008, now Pat. No. 7,959,268.

(30) Foreign Application Priority Data

Jun. 20, 2007 (JP) ..... 2007-162211
Jul. 20, 2007 (JP) ..... 2007-189062
May 22, 2008 (JP) ..... 2008-133801

(51) Int. Cl.
*B41J 2/17* (2006.01)
*B41J 2/175* (2006.01)

(52) U.S. Cl. ..... 347/84; 347/86

(58) Field of Classification Search ..... 347/84–86
See application file for complete search history.

(56) References Cited

U.S. PATENT DOCUMENTS 4,878,069 A 10/1989 Kiyohara
6,106,112 A 8/2000 Okubo et al.
6,264,318 B1 7/2001 Oda et al.
6,302,535 B1 10/2001 Sturgeon et al.
6,669,385 B1 12/2003 King et al.
6,722,762 B2 4/2004 Miyazawa et al.
6,908,182 B2 * 6/2005 Nakazawa et al. ..... 347/86
7,077,512 B2 7/2006 Kobayashi et al.
7,097,294 B2 8/2006 Ishizawa et al.
7,226,153 B2 6/2007 Sasaki
7,244,009 B2 7/2007 Kobayashi et al.
7,290,869 B2 11/2007 Hanaoka
7,488,067 B2 2/2009 Ishizawa et al.
7,845,750 B2 12/2010 Kobayashi et al.
2002/0109760 A1 8/2002 Miyazawa et al.
2005/0057624 A1 3/2005 Hanaoka
(Continued)

FOREIGN PATENT DOCUMENTS

JP 3184873 A 8/1991
(Continued)

OTHER PUBLICATIONS

US Office Action dated Jan. 13, 2011 for U.S. Appl. No. 12/142,469.
(Continued)

*Primary Examiner* — Geoffrey Mruk

(57) ABSTRACT

A fluid ejection device ejecting a fluid, the fluid ejection device includes: a fluid ejection unit; a main chassis case; a fluid-containing pack; a container case; and a plurality of holders. The fluid ejection unit ejects a fluid onto an ejection target. The main chassis case houses the fluid ejection unit. The fluid-containing pack contains a fluid for ejection. The container case houses the fluid-containing pack. The plurality of holders is disposed inside the container case. Each of a plurality of holders includes an incline panel that inclines toward the inside base plane, and the fluid-containing pack rests on the incline panel.

8 Claims, 25 Drawing Sheets

U.S. PATENT DOCUMENTS

| | | | |
|---|---|---|---|
| 2005/0168545 | A1 | 8/2005 | Sakai et al. |
| 2008/0316283 | A1 | 12/2008 | Osawa et al. |
| 2008/0316284 | A1 | 12/2008 | Osawa et al. |

FOREIGN PATENT DOCUMENTS

| | | | |
|---|---|---|---|
| JP | 2000-229421 | A | 8/2000 |
| JP | 2002-200749 | A | 7/2002 |
| JP | 2003-053984 | A | 2/2003 |
| JP | 2003-170611 | A | 6/2003 |
| JP | 2004-155036 | A | 6/2004 |
| JP | 2004-284353 | A | 10/2004 |
| JP | 2004-306340 | A | 11/2004 |
| JP | 2005-47258 | A | 2/2005 |
| JP | 2005-297286 | A | 10/2005 |
| JP | 2006-192664 | A | 7/2006 |
| JP | 2007-136748 | A | 6/2007 |

OTHER PUBLICATIONS

U.S. Appl. No. 12/142,529, Office Action dated Aug. 26, 2010.

* cited by examiner

INSTALLING FLUID CONTAINER IN FLUID EJECTION DEVICE

CROSS-REFERENCE TO RELATED APPLICATIONS

This is a Continuation Application of application Ser. No. 12/142,529, filed Jun. 19, 2008, which claims benefit from Japanese Patent Applications No. 2007-162211 filed on Jun. 20, 2007, No. 2007-189062 filed on Jul. 20, 2007, and No. 2008-133801 filed on May 22, 2008, the disclosures of which are hereby incorporated by reference in its entirety.

BACKGROUND

1. Technical Field

The present invention relates to a fluid ejection device for ejecting a fluid, and particularly to a structure by which fluid-containing packs containing fluid for ejection are positioned within the fluid ejection device.

2. Related Art

Printers of ink jet format, which eject drops of ink onto thin sheets of a recording medium such as paper or plastic in order to record text or images thereon, are a representative type of fluid ejection device. Other types of fluid ejection devices include those adapted for use in display production systems employed in the production of liquid crystal displays, plasma displays, organic EL (Electro Luminescence) displays, field emission displays (FED), and the like, and used for ejecting various types of liquid materials to form coloring material, electrodes, etc. in the pixel regions or electrode regions.

A typical fluid ejection device is equipped with a carriage on which rides an ejection head for ejecting fluid onto an ejection target; the location for fluid ejection onto the ejection target is adjusted by moving either the carriage or the recording medium, or both. Where a fluid ejection device employs a system in which a fluid-containing pack containing fluid for ejection is positioned apart from the carriage (known as an off-carriage system) it will be possible to reduce the load associated with driving the carriage. Patent Citation JP 2005-47258 A discloses such a printer of off-carriage type in which an ink cartridge containing ink packs is inserted into the printer unit.

SUMMARY

However, in the past, sufficient consideration was not given to a design able to accommodate fluid-containing packs of larger capacity. For example, there were problems such as the difficulty of ensuring sufficient space in the unit to accommodate fluid-containing packs of larger capacity; and of the increased weight fluid-containing packs of bearing on other adjacent packs and causing leakage of fluid.

In view of this problem, an advantage of some aspects of the invention is to provide a fluid ejection device able to accommodate larger capacity fluid-containing packs.

An advantage of some aspects of the invention is intended to address this issue at least in part, and can be reduced to practice as described below.

A fluid ejection device according to an aspect of the invention is a fluid ejection device ejecting a fluid, the fluid ejection device comprising: a fluid ejection unit; a main chassis case; a plurality of fluid-containing packs; a container case; and a plurality of holders. The fluid ejection unit ejects a fluid onto an ejection target. The main chassis case houses the fluid ejection unit. The plurality of fluid-containing packs contains a fluid for ejection. The container case houses the plurality of fluid-containing packs. The plurality of holders is disposed inside the container case. Each of the plurality of holders includes an incline panel that inclines toward the inside base plane, and the fluid-containing pack rests on the incline panel. According to the above-mentioned fluid ejection device, the individual fluid-containing packs are respectively carried on the incline panels of the holders, thereby preventing the weight of fluid-containing packs from bearing on neighboring packs.

A method according to an aspect of the invention is a method of manufacturing a fluid ejection device for ejecting a fluid, the method comprising: storing a fluid-containing pack in a container case, wherein the fluid-containing pack contains a fluid for ejection and rests on an incline panel of a holder, the incline panel inclines toward a inside base plane of the container case, and the holder is fixed to the inside base plane; and sealing the container case in which the fluid-containing pack is stored. According to the above-mentioned method, the fluid-containing packs can be accommodated within the container case while being held from below by the holders, thereby preventing damage to the fluid-containing packs during the procedure for installing them in the container case.

The invention is not limited to being embodied as a fluid ejection device or a method of manufacture thereof, and may be reduced to practice in other modes having a structure for accommodating fluid-containing packs. The invention should not be construed as limited to the embodiments set forth hereinabove, and naturally various modifications such as the following may be made herein without departing from the scope of the invention.

These and other objects, features, aspects, and advantages of the invention will become more apparent from the following detailed description of the preferred embodiments with the accompanying drawings.

BRIEF DESCRIPTION OF THE DRAWINGS

The invention will be described with reference to the accompanying drawings in which.

DESCRIPTION OF THE PREFERRED EMBODIMENTS

A better understanding of the design and advantages of the invention set forth above will be provided through the following description of the invention embodied in a fluid ejection device. In the embodiment, a printer of ink-jet type will be described as an example representative of a picture recording device, as one embodiment of a fluid ejection device.

A. Embodiment

Figure 1:
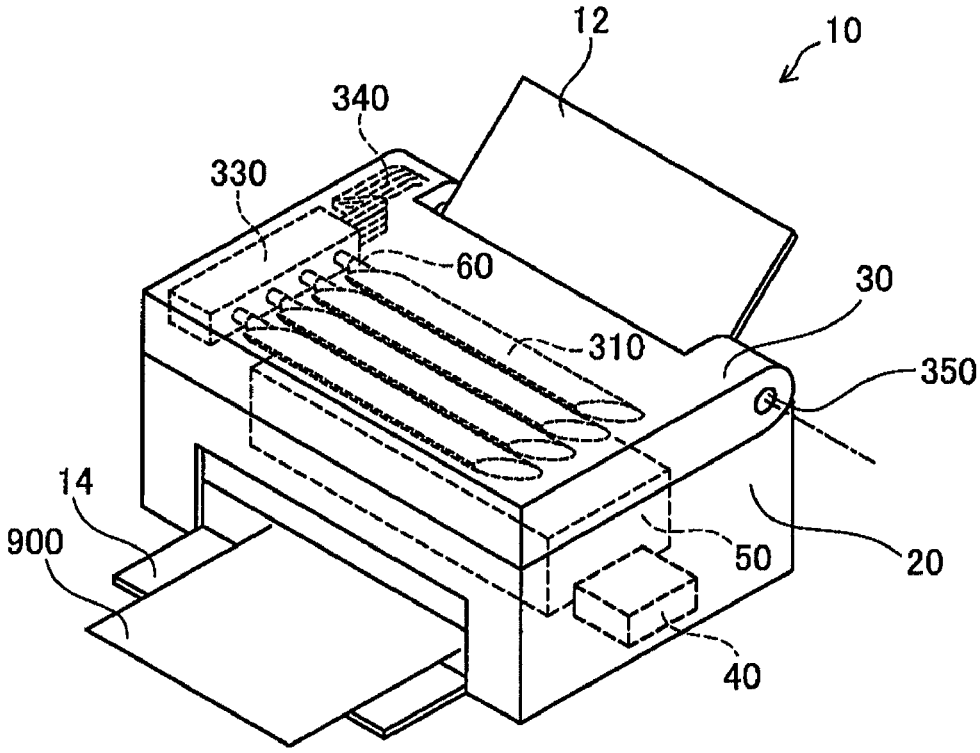
FIG. 1 is an illustration depicting in simplified form a configuration of a printer.

FIG. 1 is an illustration depicting in simplified form the design of a printer 10. The printer 10 is a printer of ink-jet type which records text and images by ejecting ink drops onto a recording medium, namely, printer paper 900. The printer 10 includes a main chassis unit 20 which houses a printing mechanism section 50 which constitutes the fluid ejection portion for ejecting ink drops onto the printer paper 900; the main chassis unit 20 houses a paper feed tray 12 for loading into the interior of the main chassis unit 20 the printer paper 900 which is to be supplied to the printing mechanism section 50, as well as a paper output tray 14 for guiding out from the main chassis unit 20 the printer paper 90 which has been discharged from the printing mechanism section 50. The specifics of the design of the printing mechanism section 50 will be discussed later.

Also housed in the main chassis unit 20 is a controller section 40 for controlling the various parts of the printer 10. In the embodiment, the controller section 40 includes ASICs (Application Specific Integrated Circuits) furnished with hardware such as a central processing unit (CPU), read only memory (ROM), and random access memory (RAM). Software for accomplishing the various functions of the printer 10 is installed in the controller section 40.

On the upper face of the main chassis unit 20 is installed an upper chassis unit 30 which constitutes the container case for accommodating a plurality of ink packs 310 respectively containing liquid inks of different colors. The upper chassis unit 30 is pivotably attached to the main chassis unit 20 so as to open and close about a rotation shaft 350.

In the embodiment, the ink packs 310 take the form of flat bag portions of generally rectangular shape made of pliable sheeting and having generally elliptical cross section; a pack aperture 60 from which ink may be withdrawn is provided on one of the short sides. The specific design of the pack aperture 60 will be discussed later. In the embodiment, the plurality of ink packs 310 are held stacked on an incline with one long side thereof upraised. In the embodiment, the upper chassis unit 30 accommodates four ink packs 310 for individual inks of the four colors black, cyan, magenta, and yellow. In an alternative embodiment, in a printer adapted to carry out printing with light cyan and light magenta in addition to these four colors for a total of six colors, the upper chassis unit 30 could be designed to accommodate six ink packs 310 for individual inks of six colors including the additional light cyan and light magenta.

The upper chassis unit 30 which constitutes the ink delivery unit for the printing mechanism section 50 has an ink delivery section 330 which connects to the ink packs 310 so as to enable ink to be dispensed from them. A delivery tube 340 which defines a fluid passage allowing the ink dispensed from the ink packs 310 to flow down to the printing mechanism section 50 connects with the ink delivery section 330. The delivery tube 340 can be fabricated of gas permeable material, for example, a thermoplastic elastomer such as an olefin or styrene.

Figure 2:
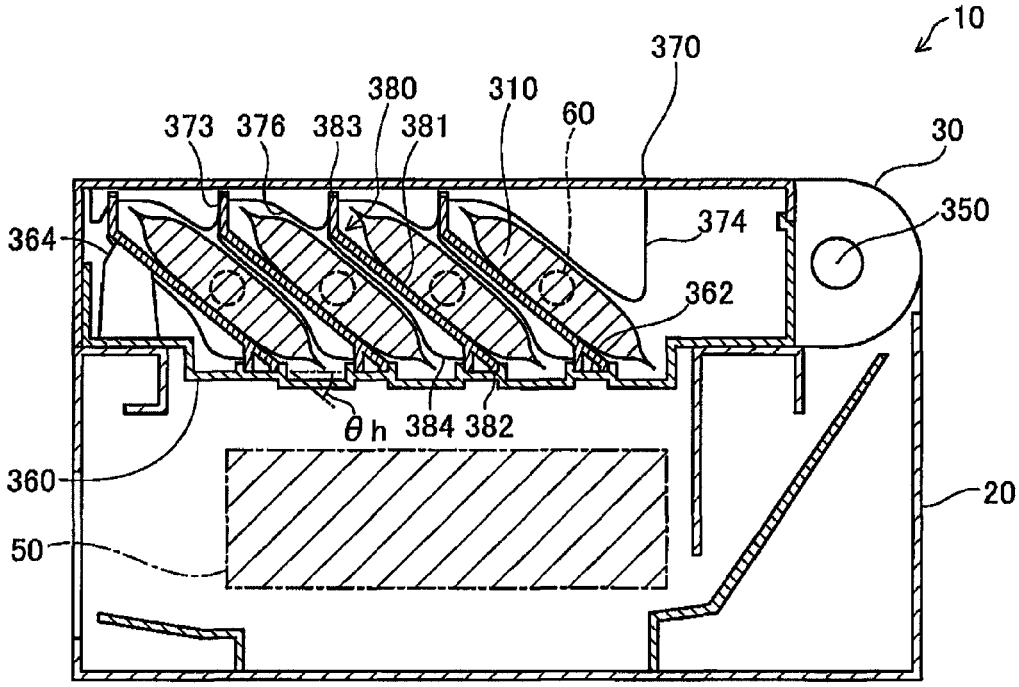
FIG. 2 is a sectional view depicting in simplified form the configuration of the printer with the upper chassis unit closed.
Figure 3:
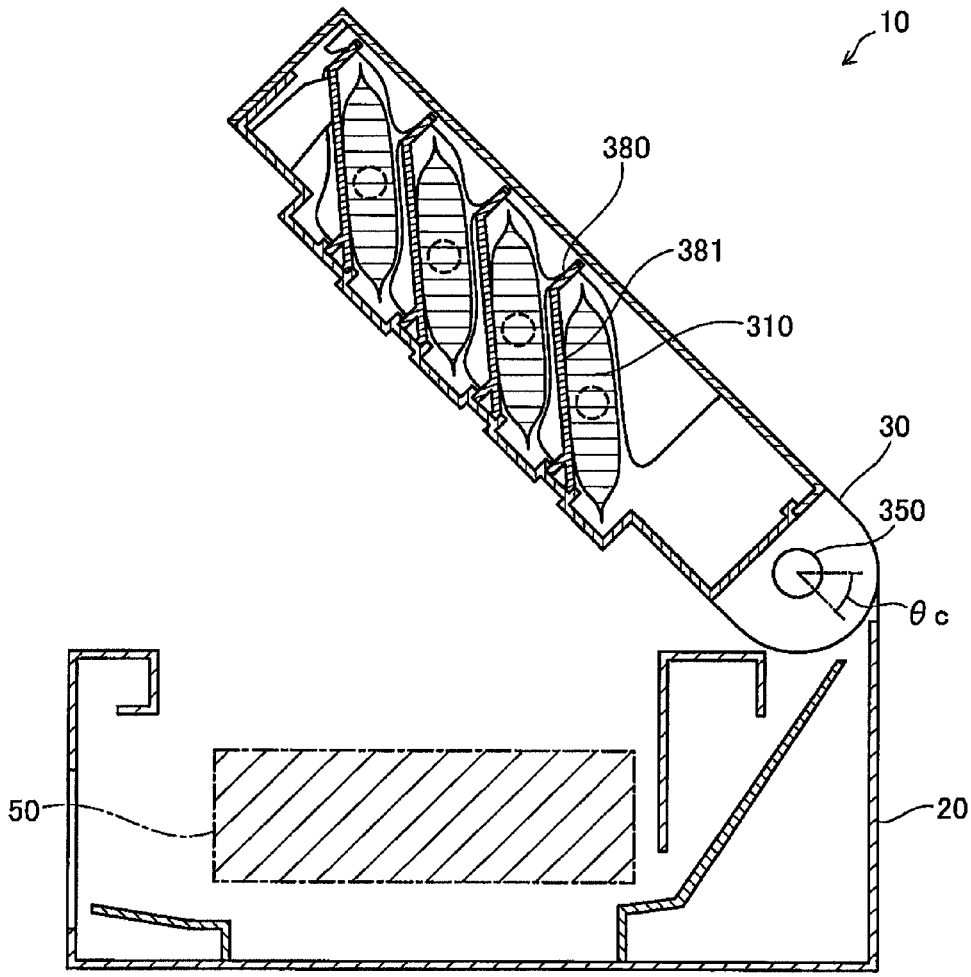
FIG. 3 is a sectional view depicting in simplified form the configuration of the printer with the upper chassis unit open.
Figure 4:
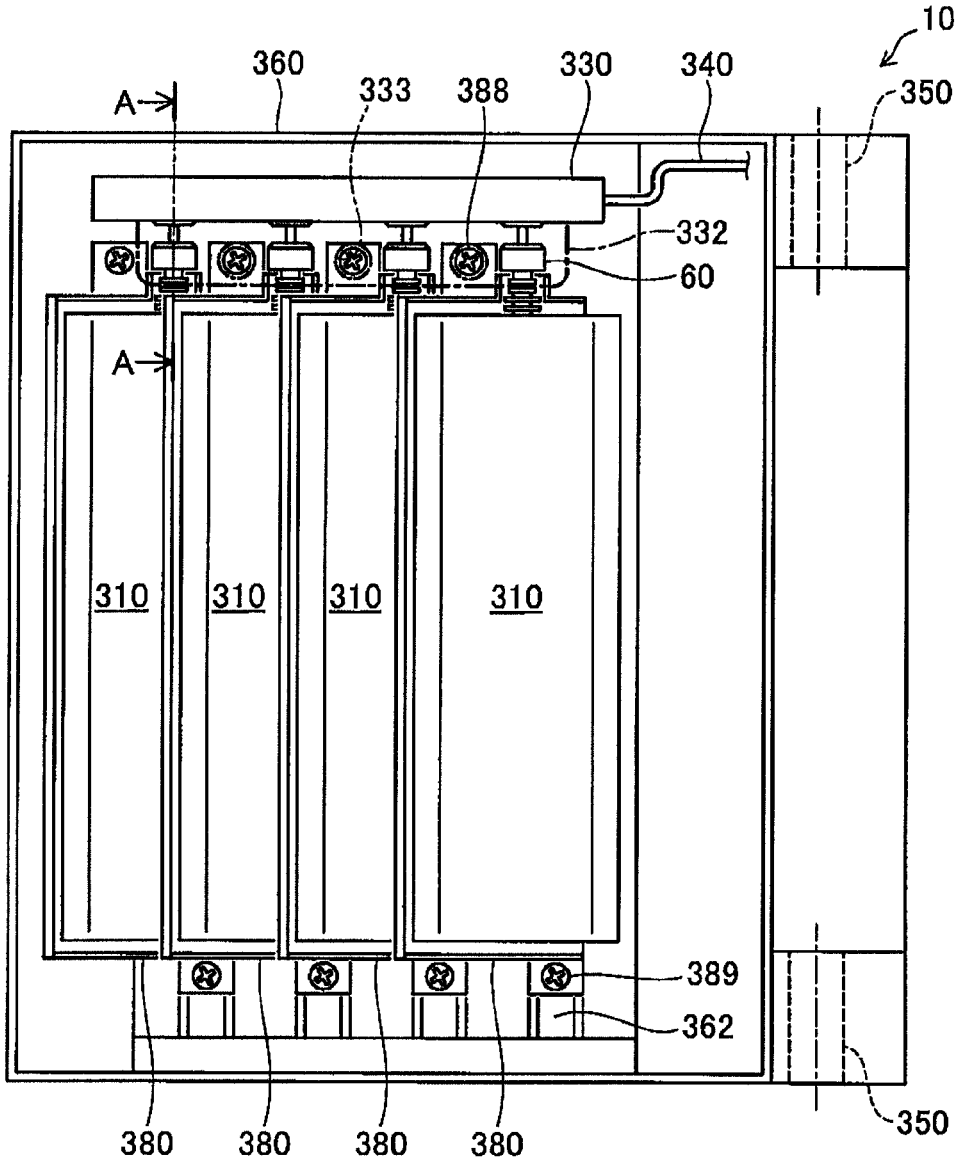
FIG. 4 is a top view showing the interior of the upper chassis unit.

FIG. 2 is a sectional view depicting in simplified form the configuration of the printer 10 with the upper chassis unit 30 closed. FIG. 3 is a sectional view depicting in simplified form the configuration of the printer 10 with the upper chassis unit 30 open. FIG. 4 is a top view showing the interior of the upper chassis unit 30. The upper chassis unit 30 has a lower housing 360 which constitutes the inside lower face of the upper chassis unit 30; and an upper housing 370 which constitutes the inside top wall of the upper chassis unit 30. Inside the lower housing 360 are disposed a plurality of holder guides 362 constituted in sections of the inside lower face defined by the lower housing 360, and extending approximately parallel to the rotation shaft 350 and spaced at approximately equal intervals apart from one another. As shown in FIG. 3, in the embodiment, the upper part of the printing mechanism section 50 housed within the main chassis unit 20 will lie exposed by opening the upper chassis unit 30.

As shown in FIG. 2, a plurality of holders 380 on which the ink packs 310 rest are provided within the upper chassis unit 30. The holders 380 have inclined panels 381 which are inclined with respect to the holder guides 362. The ink packs 310 are arranged resting against the upper faces of the inclined panels 381 of the holders 380, with one side face of the flat bag which makes up the ink pack 310 in contact therewith. In the embodiment, the ink packs 310 are attached with double-sided tape on at least a portion of the face thereof contacting the inclined panel 381 of the holder 380. In the lower section of the inclined panel 381 of the holder 380 there is formed a base section 382 which is fittable within the holder guide 362. After the base section 382 has been fitted into the holder guide 362, the holder 380 will be secured fastened to the lower housing 360 by fastening screws 388, 389 which constitute the fastening components. The plurality of holders 380 are positioned in a row staggered along the inside lower face of the lower housing 360, with the inclined panel 381 of one holder 380 overlapping the top of the ink pack 310 which rests on another holder situated adjacently in the direction of incline of the inclined panels 381. As depicted in FIGS. 2 and 3, the inclined panels 381 of the holders 380 are inclined with respect to the holder guides 362 of the lower housing 360, by an angle of incline θh enabling them to remain in contact with the ink packs 310 from below in the direction of gravity as the upper chassis unit 30 moves from the closed position to the open position. In the embodiment, the allowable rotation angle θc for opening and closing of the upper chassis unit 30 about the rotation shaft 350 is approximately 45 degrees, whereas the angle of incline θh of the inclined panels 381 with respect to the holder guides 362 is approximately 40 degrees.

As shown in FIG. 2, on the back face of the inclined panel 381 of each holder 380 is pendently disposed a back face reinforcing rib 384 having a tabular contour which extends along the ink pack 310 resting on the adjacent holder 380. On the inside lower face of the lower housing 360 is disposed a holder reinforcing rib 364 of tabular contours which rises up to meet the bottom of the inclined panel 381 of the holder 380 situated at the end in the direction of incline of the inclined panels 381 in the row of holders 380. In the embodiment, the upper part of the holder reinforcing rib 364 abuts the back face of the inclined panel 381 of this holder 380. On the inside top wall of the upper chassis unit 30 is pendently disposed an end portion reinforcing rib 374 having a tabular contour which extends towards the upside of the ink pack 310 resting on the holder 380 situated at the end opposite from the direction of incline of the inclined panels 381 in the row of holders 380. On the inside top wall of the upper chassis unit 30 is also pendently disposed a medial reinforcing rib of tabular contours which extends along the upside of the ink pack 310 resting on the holder 380, along a zone sandwiched between two of the holders 380. Also disposed on the inside top wall of the upper chassis unit 30 is a mating portion 373 which mates with the upper edge portion 383 of the inclined panel 381 of a holder 380.

As shown in FIGS. 2 and 3, the lower housing 360 of the upper chassis unit 30 has contours which jut downward in sections where the ink packs 310 are located. It is possible thereby to expand the amount of space available for installation of the ink packs 310 inside the upper chassis unit 30. Since the printer 10 of the embodiment is a printer of off-carriage type in which the containers containing the ink are positioned away from the carriage, the printing mechanism section 50 can be lower in height as compared with a printer of on-carriage type in which the containers containing the ink ride on the carriage. For this reason, in the printer 10 of the embodiment, sections of the lower housing 360 can jut downward without the risk of interfering with the printing mechanism section 50. Consequently, simply by making a small change, namely that of modifying the shape of the lower housing 360, it would be possible for example to adapt a chassis for use in a printer of existing on-carriage type equipped with a scanner function in the section corresponding to the upper chassis unit 30, so that it can be used as the chassis of the printer 10 in the present embodiment.

As shown in FIG. 4, the ink delivery section 330 has a guard plate 332 disposed covering the top of the connector portions with the apertures 60 of the ink packs 310. The guard plate 332 has openings 333 to permit insertion of a tool for tightening fastening screws 388 which fasten the holders 380 to the lower housing 360.

Figure 5:
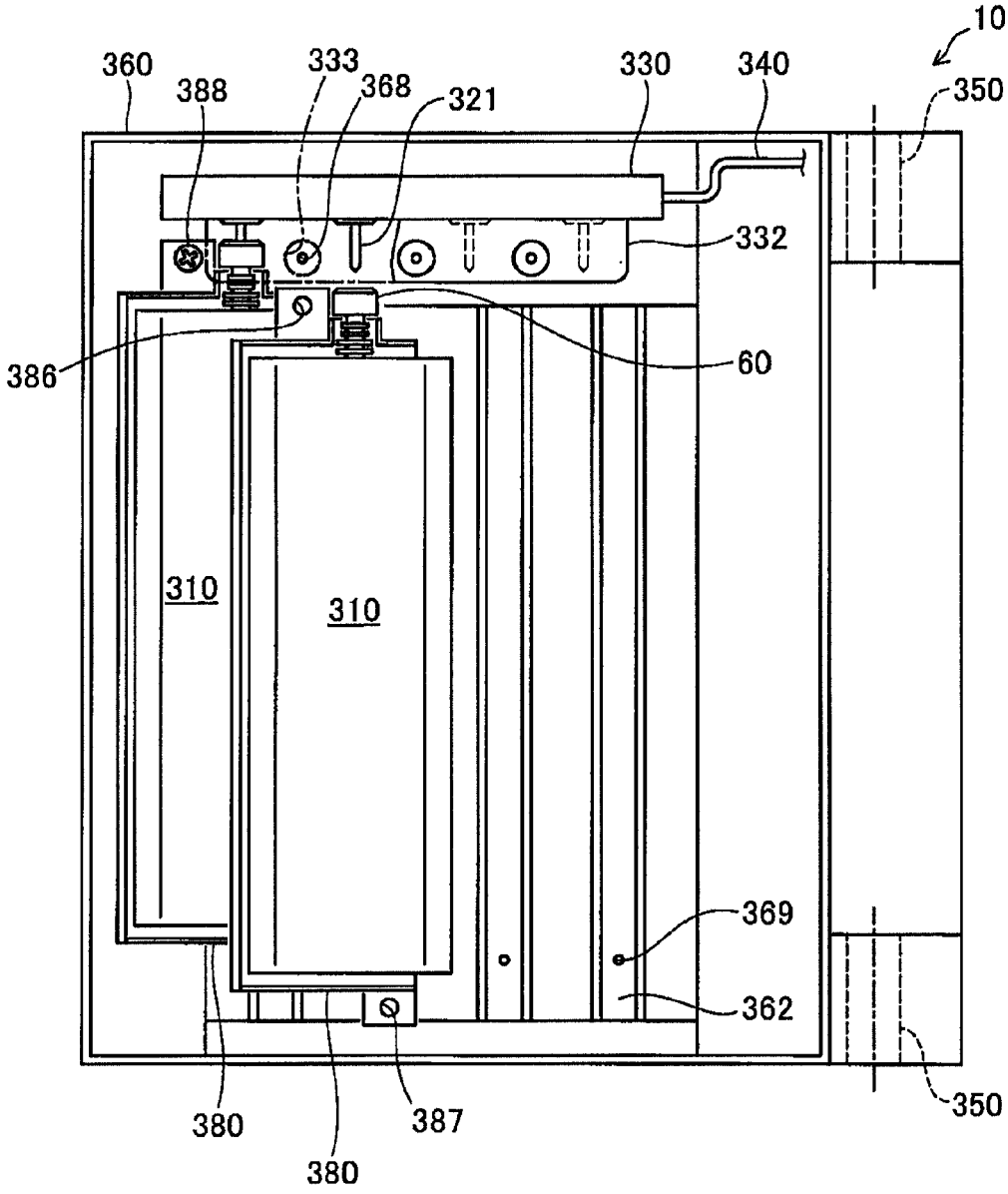
FIG. 5 is an illustration depicting fastening of holders carrying ink packs within the upper chassis unit.

FIG. 5 is an illustration depicting fastening of holders 380 carrying ink packs 310 within the upper chassis unit 30. In each of the holders 380, a through hole 386 adapted for passage and engagement of a fastening screw 388 is formed at a location adjacent to the pack aperture 60 of the ink pack 310, and a through hole 387 adapted for passage and engagement of a fastening screw 388 is formed at a location adjacent to the opposite end from the pack aperture 60 of the ink pack 310. In the lower housing of the upper chassis unit 30, at fastening locations where the holders 380 carrying the ink packs 310 are to be fastened, there are formed screw holes 368 for threadably engaging the fastening screws 388 passed through the through holes 386 of the holders 380, as well as screw holes 369 for threadably engaging the fastening screws 388 passed through the through holes 387 of the holders 380.

During the process of fastening the holders 380 carrying the ink packs 310 in the interior of the upper chassis unit 30, first, the base portion 382 of the holder 360 carrying the ink pack 310 is fitted from above into one of the holder guides 362 of the lower housing 360. Then, the holder 380 is slid along the holder guide towards a delivery needle 320 until the delivery needle 320 inserts into the aperture of the ink pack 310. The holder 380 is then fastened to the lower housing 360 with the fastening screws 388, 389.

Figure 6:
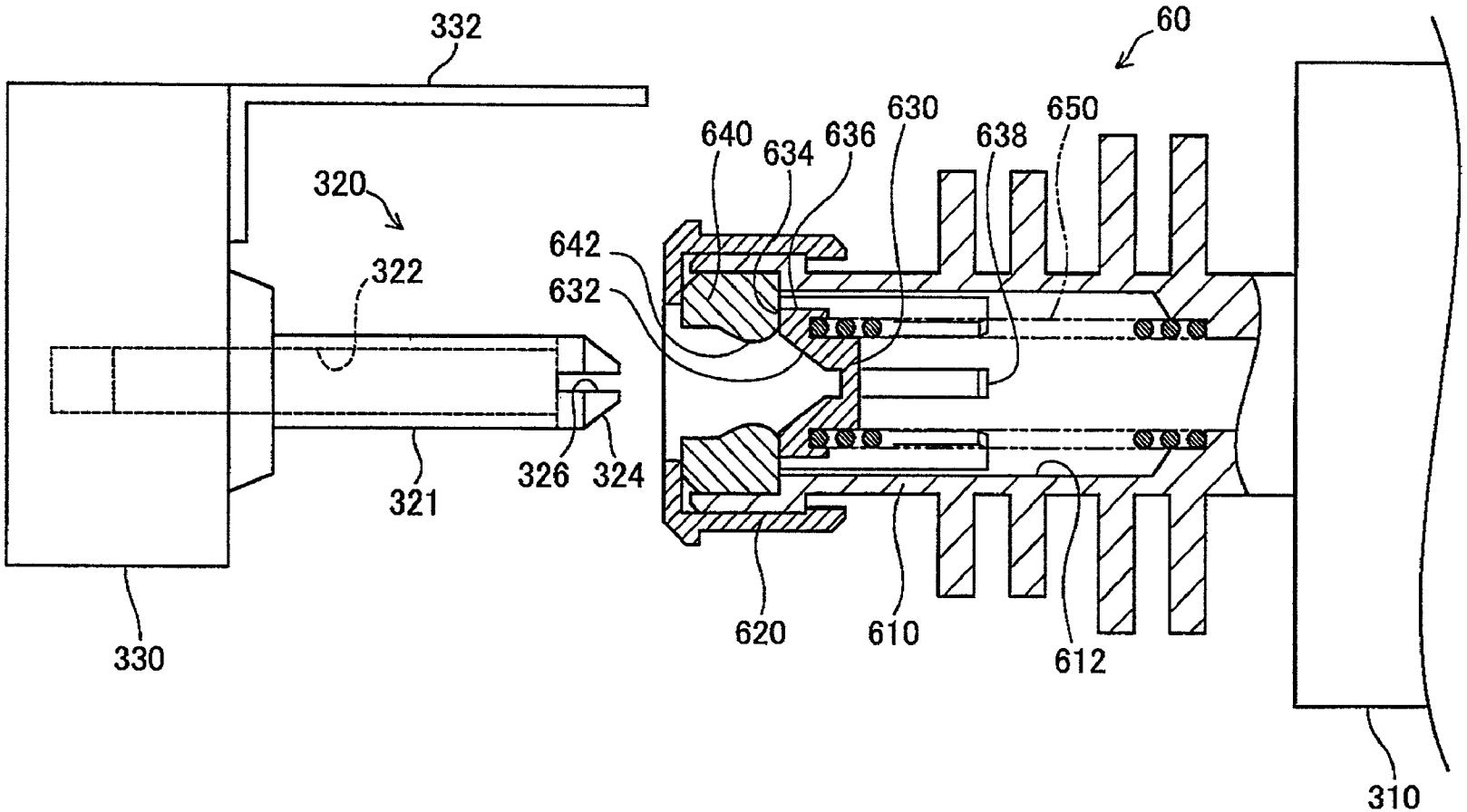
FIG. 6 is an illustration depicting an ink pack prior to connection with the ink delivery section, viewed in A-A cross section in FIG. 4.
Figure 7:
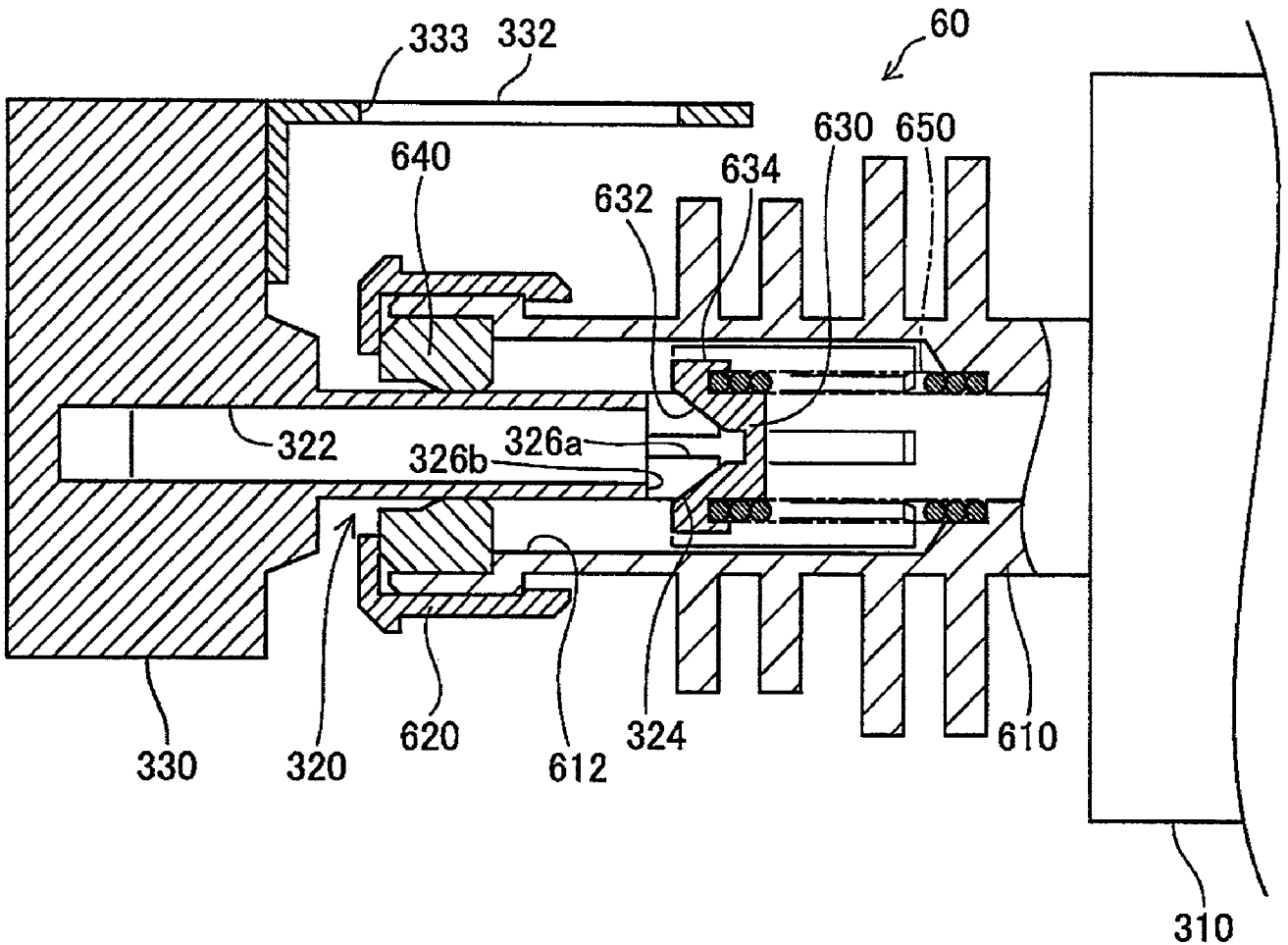
FIG. 7 is an illustration depicting an ink pack connected with the ink delivery section, viewed in A-A cross section in FIG. 4.

FIG. 6 is an illustration depicting an ink pack 310 prior to connection with the ink delivery section 330, viewed in A-A cross section in FIG. 4. FIG. 7 is an illustration depicting an ink pack 310 connected with the ink delivery section 330, viewed in A-A cross section in FIG. 4. The delivery needles 320, each of which has a hollow flow passage 322 communicating with the delivery tube 340, are provided to the ink delivery section 330. A first end of the delivery needle 320 has a tip 324 of tapered shape. A delivery channel 326 which communicates with the hollow flow passage 322 is formed in the tip 324 of the delivery needle 320. The delivery channel 326 is formed from the tip of the delivery needle 320 to a side wall 321 which extends generally along the center axis of the delivery needle 320. As shown in FIG. 7, the delivery channel 326 of the delivery needle 320 is defined by a vertical face **326*a* which extends generally along the center axis of the delivery needle 320, and a lateral face 326*b* which intersects the center axis of the delivery needle 320. In the embodiment, the delivery channel 326 of the delivery needle 320 is formed with a cross shape ("+(plus)" shape) having its intersection point at the center axis of the delivery needle 320. In the embodiment, the delivery needle 320 is a resin component which has been integrally molded with the ink delivery section 330** using a mold.

The pack aperture 60 provided to each of the ink packs 310 is provided with a delivery aperture portion 610 having formed therein a delivery aperture 612 which communicates with the interior of the ink pack 310. A cylindrical gasket 640 having a through hole 642 which mates intimately with the delivery needle 320 inserted into the delivery aperture 612 is disposed at the inlet of the delivery aperture 612. The gasket 640 installed in the delivery aperture 612 is forced into the delivery aperture 612 by a cap 620 which fits onto the delivery aperture portion 610.

A valve body 630 having a sealing face 634 that intimately attaches to the gasket 640 is housed within the delivery aperture 612. The valve body 630 housed within the delivery aperture 612 is urged towards the gasket 640 from the interior of the delivery aperture 612 by a coil spring 650 which constitutes a resilient member, and seals off the through hole 642 of the gasket 640. The valve body 630 is provided with a plurality of guides 638 disposed contacting the inside wall of the delivery aperture 612 generally along the center axis of the delivery aperture 612; between the plurality of guides 638 are defined offset faces 636 which are offset from the inside face of the delivery aperture 612. A mating face 632 adapted to mate with the tip 324 of the delivery needle 320 is formed on the valve body 630 on the side thereof which abuts the gasket 640.

As shown in FIG. 7, when the delivery needle 320 is inserted into the through-hole 642 of the gasket 640, with the tip 324 of the delivery needle 320 mated with the mating face 632 of the valve body 630, the valve body 630 will be pushed inward towards the ink pack 310 within the delivery aperture 612. During this process, since the delivery channel 326 of the delivery needle 320 has been formed so as to extend from the tip 324 to the side wall 321 and beyond the mating face 632 of the valve body 630, the channel will now communicate with the delivery aperture 612. The interior of the ink pack 310 will thereby be placed in communication with the hollow flow passage 322 of the delivery needle 320, via the offset faces 636 of the valve body 630 and the delivery channel 326 of the delivery needle 320.

Figure 8:
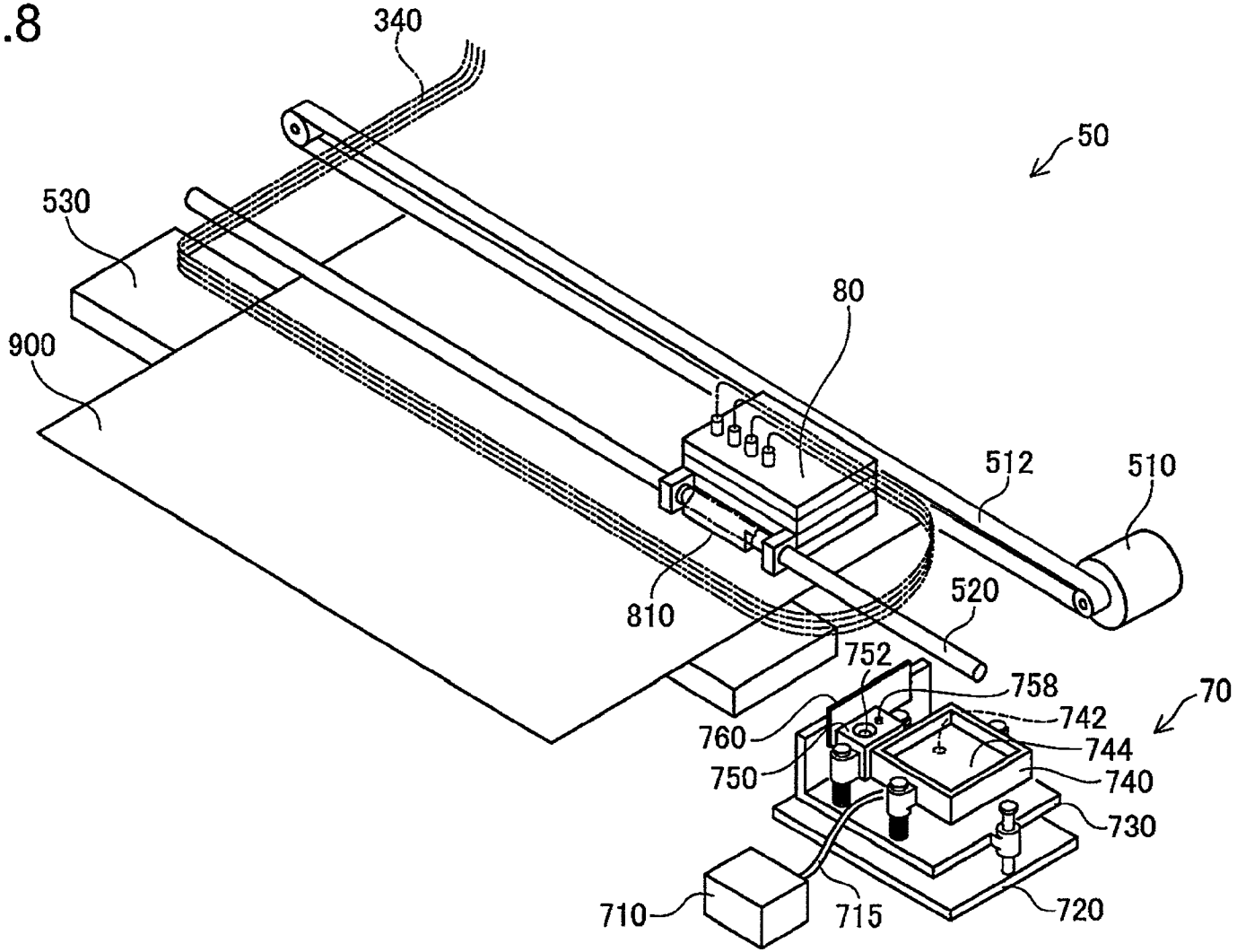
FIG. 8 is an illustration depicting a configuration of a printing mechanism section of a printer.

FIG. 8 is an illustration depicting a configuration of the printing mechanism section 50 of the printer 10. The printing mechanism section 50 has a platen 530 of rectangular shape disposed in a printing area where ejection of ink drops onto the printer paper 900 will be carried out. The printer paper 900 is transported over the platen 530 by a paper feed mechanism (not shown). The printing mechanism section 50 also has a carriage 80 which is connected to the delivery tube 340 and which carries an ejection head 810. The carriage 80 is moveably supported in the lengthwise direction of the platen 530 along a guide rod 520, and is driven via a timing belt 512 by a carriage motor 510 which constitutes the carriage driving section. The carriage 80 thereby undergoes reciprocating motion in the lengthwise direction over the platen 530. In the interior of the main chassis unit 20, a home position where the carriage 80 waits in standby is provided in a nonprinting area away to one side of the printing area where the platen 530 is located. A maintenance mechanism section 70 maintaining the carriage 80 is disposed at this home position.

Figure 9:
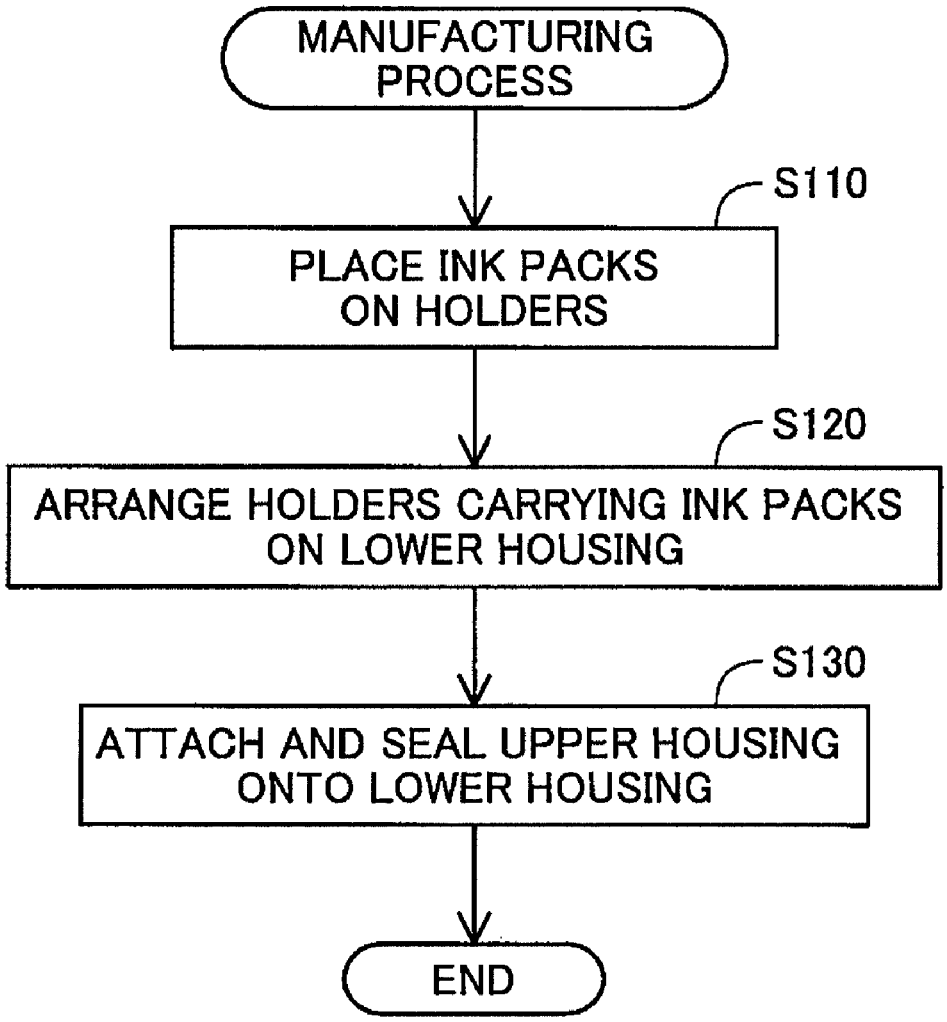
FIG. 9 is a flowchart depicting a method of manufacturing the printer.

FIG. 9 is a flowchart depicting a method of manufacturing the printer 10. When installing the ink packs 310 in the printer 10, first, the ink-filled ink packs 310 are positioned on the inclined panels 381 of the holders 380 (Step S110). The holders 380 carrying the ink packs 310 are then fitted into the holder guides 362 of the lower housing 360, and the holders 380 are fastened to the lower housing 360 with the fastening screws 388, 389 so that the plurality of holders 380 are arranged on the lower housing 360 (Step S120). In the embodiment, in the step of arranging the plurality of holders 380 on the lower housing 360 (Step S120), the pack openings 60 of the ink packs 310 will connect with the delivery needles 320, thereby placing the interior of the ink packs 310 in communication with the ejection head 810 of the printing mechanism section 50 which constitutes the fluid ejecting portion. Subsequently, the lower housing in which the plurality of holders 380 have been arranged will be sealed with the upper housing 370, whereby the plurality of ink packs 310 are housed in the interior of the main chassis unit 30 (Step S130).

According to the printer 10 of the embodiment described above, by opening the upper chassis unit 30 it will be possible to access parts of the main chassis unit 20 which are normally covered by the upper chassis unit 30, thereby improving the degree of freedom in positioning of the ink packs 310. Moreover, because the upper chassis unit 30 is pivotably attached to the main chassis unit 20 allowing the top part of the printing mechanism section 50 to be opened or closed, the upper chassis unit 30 which houses the ink packs 310 can be utilized as the cover for the printing mechanism section 50; and by opening the upper chassis unit 30 it will be possible to easily perform maintenance on the printing mechanism section 50 housed within the main chassis unit 20.

Moreover, because the individual ink packs 310 respectively rest on the inclined panels 381 of the holders 380, the plurality of ink packs 310 can be stacked and accommodated efficiently, while preventing the weight of ink packs 310 from bearing on neighboring ink packs 310. Additionally, because the ink packs 310 are retained from below as the upper chassis unit 30 moves from the closed state to the open state, the ink packs 310 will be prevented from pushing with excessive force against neighboring holders 380 due to gravity.

Furthermore, by disposing the holder reinforcing rib 364 on the lower housing 360, the holder 380 can be reinforced with respect to force acting in the direction of incline of the inclined panels 381. Moreover, by disposing the end portion reinforcing rib 374 on the upper housing 370, it will be possible to avoid excessive deformation of the ink pack 310 carried on the holder 380 which is situated at the end opposite the direction of incline of the inclined panels 381. Additionally, by disposing the medial reinforcing rib 376 on the upper housing 370, it will be possible to avoid excessive deformation at the upside of an ink pack 310 unsupported by the back face of the inclined panel 381 of the adjacent holder. Furthermore, because the upper edge portion 383 of the inclined panel 381 of the holder 380 mates with the mating portion 373 disposed on the upper housing 370, it is possible to prevent the holder 380 from experiencing excessive deformation.

B. Alternative Embodiments

The foregoing description of the invention based on certain preferred embodiments should not be construed as limiting of the invention, and various modifications will of course be possible without departing from the scope of the invention. For example, the upper chassis unit 30 need not be pivotably attached to the main chassis unit 20, and the upper chassis unit 30 may instead by slidably attached to the main chassis unit 20. With this design, the ink packs 310 can be housed in a more stable condition within the upper chassis unit 30.

Figure 10:
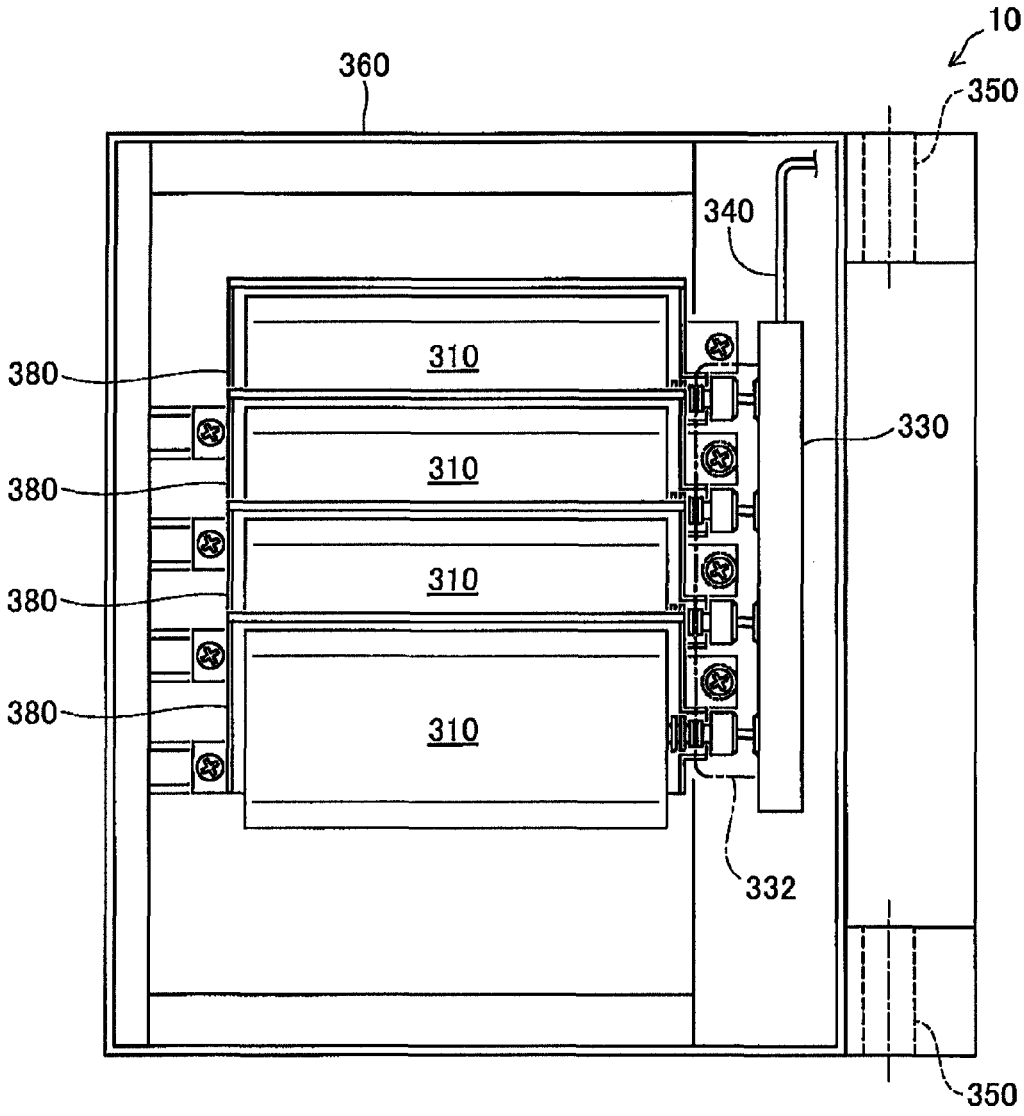
FIG. 10 is a top view showing the interior of the upper chassis unit in an alternative embodiment.
Figure 11:
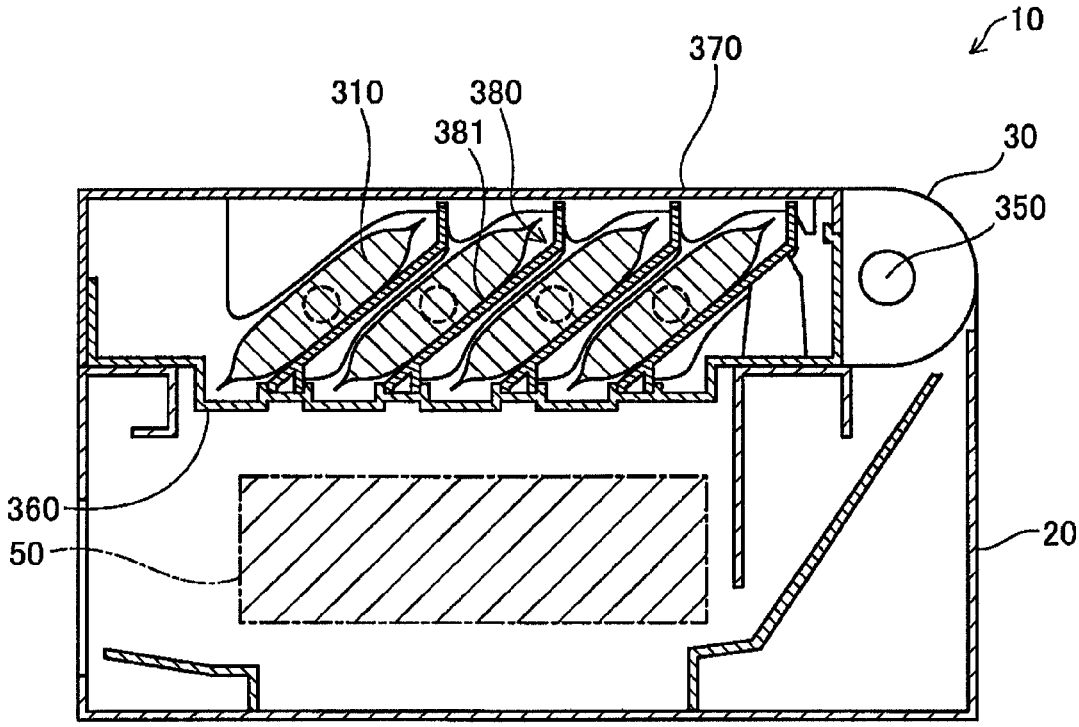
FIG. 11 is a sectional view depicting in simplified form the configuration of a printer in an alternative embodiment, shown with the upper chassis unit closed.

Another possible orientation of the holders 380 on the lower housing 360 is that depicted in FIG. 10 wherein the holders 380 are arranged generally along the direction of the axis of the rotation shaft 350. According to the embodiment illustrated in FIG. 10, because the individual ink packs 310 held in the upper chassis unit 30 are maintained at generally identical height as the upper chassis unit 30 moves from the closed state to the open state, generally identical pressure head can be maintained in the inks contained in the individual ink packs 310. The ejection quality of the ink ejected from the ejection head 810 can be improved thereby. Alternatively, the holders 380 may be positioned with the direction of incline of the inclined panels 381 oriented towards the rotation shaft 350 as depicted in FIG. 11. According to the embodiment illustrated in FIG. 11, with the upper chassis unit 30 in the opened state the ink packs 310 rest in a more stable condition on the inclined panels 381 of the holders 380, as compared with the arrangement of the holders 380 depicted in FIGS. 2 and 3 in which the inclined panels 381 incline in the direction opposite from the rotation shaft 350.

The fluid targeted by the fluid ejection device of the invention is not limited to liquids such as the ink mentioned above, and various fluids such as metal pastes, powders, or liquid crystals may be targeted as well. While an ink-jet recording device equipped with an ink-jet recording head for picture recording purposes like that described is one representative example of an fluid ejection device, the invention is not limited to recording devices of ink-jet type, and has potential implementation in printers or other picture recording devices; coloring matter ejection devices employed in manufacture of color filters for liquid crystal displays and the like; electrode material devices employed in formation of electrodes in organic EL (Electro Luminescence) displays or FED (Field Emission Displays); liquid ejection devices for ejection of liquids containing bioorganic substances used in biochip manufacture; or specimen ejection devices for precision pipette applications.

Figure 12:
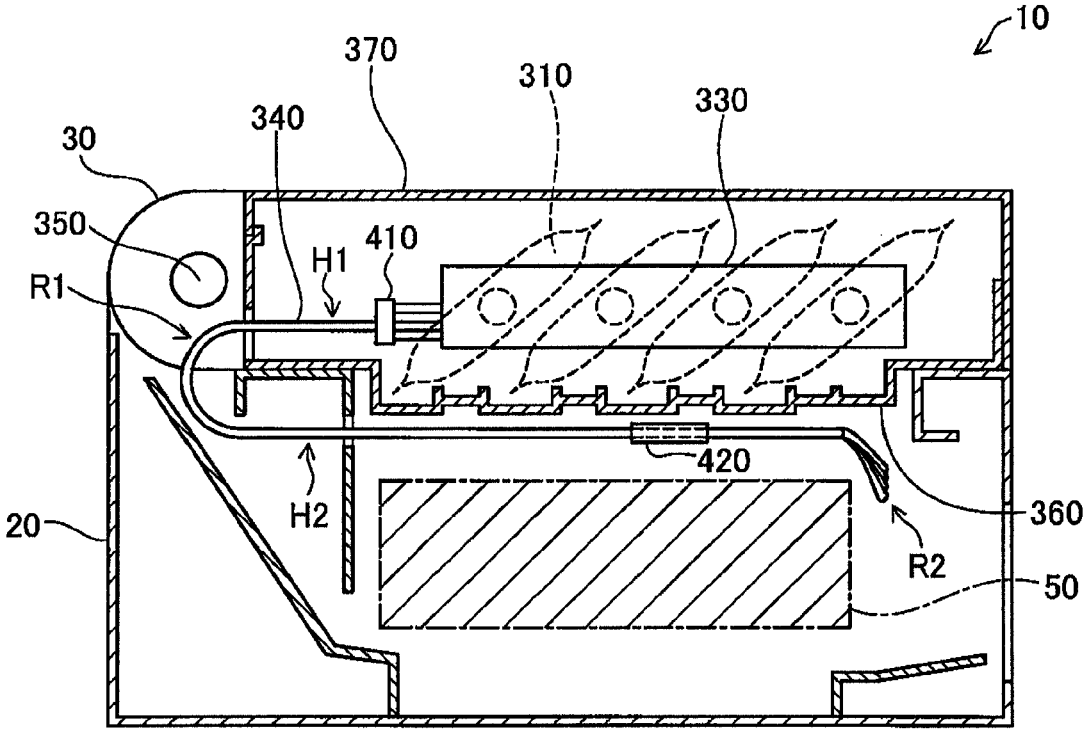
FIG. 12 is a sectional view depicting in simplified form the configuration of a printer in an alternative embodiment, shown with the upper chassis unit closed.
Figure 13:
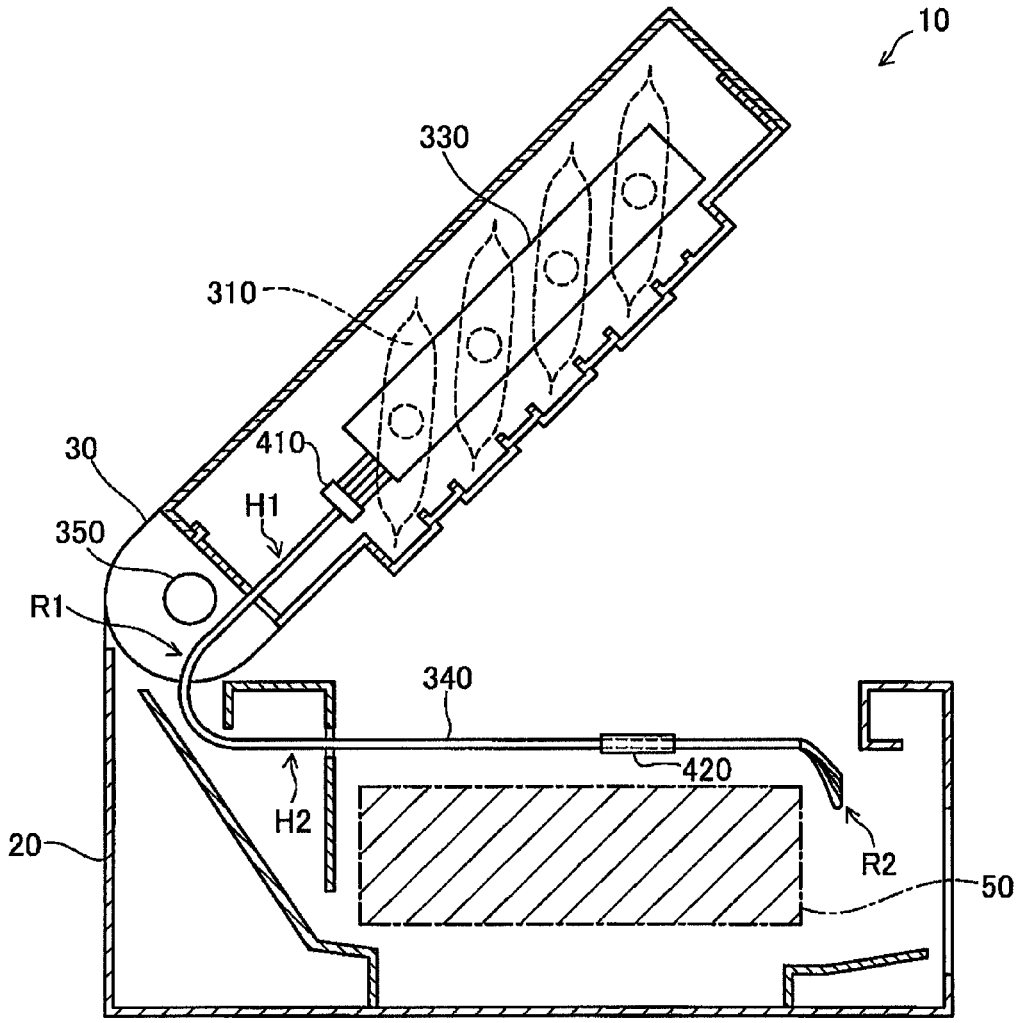
FIG. 13 is a sectional view depicting in simplified form the configuration of a printer in an alternative embodiment, shown with the upper chassis unit open.
Figure 14:
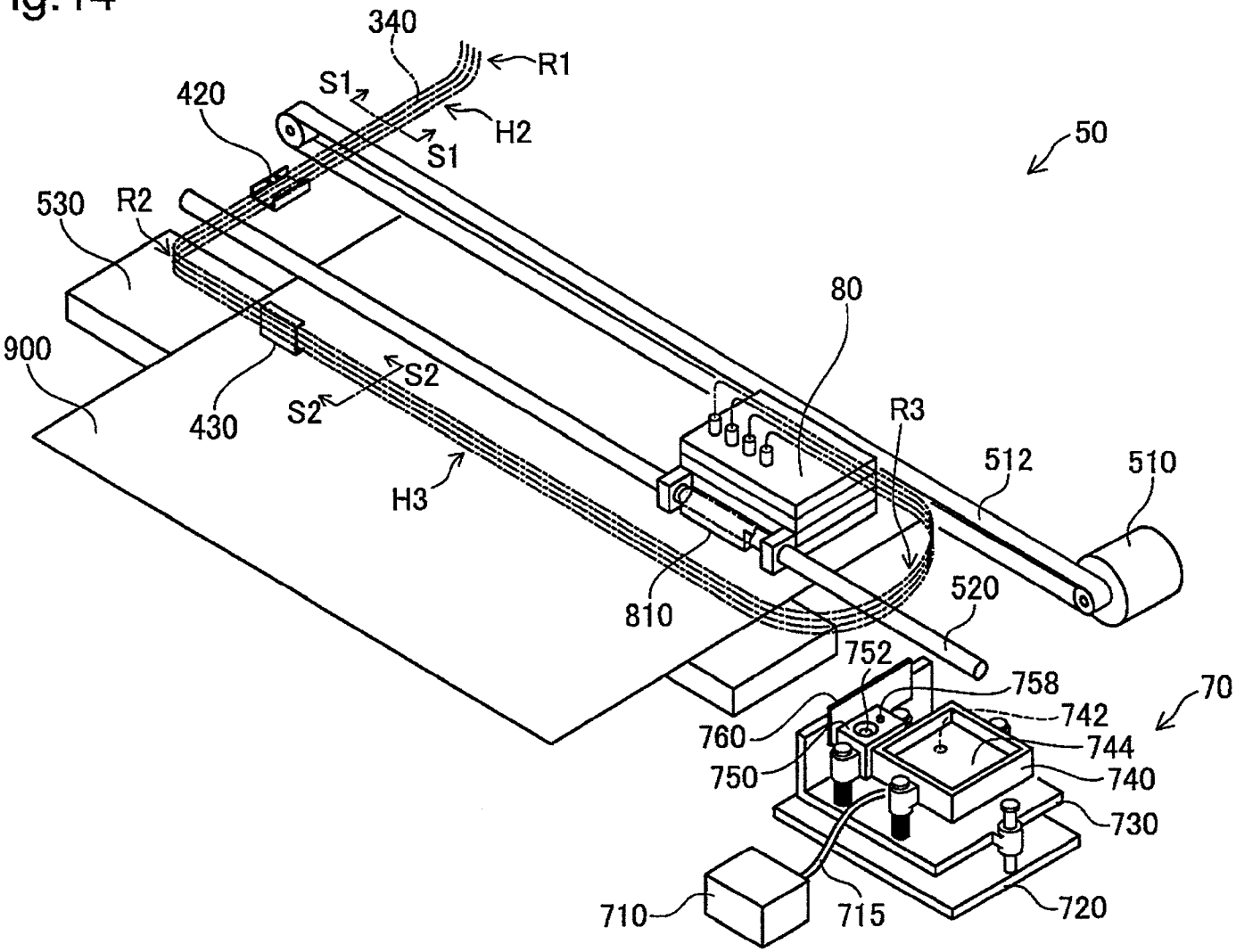
FIG. 14 is an illustration of the configuration around the printing mechanism section of the printer in the alternative embodiment.

FIG. 12 is a sectional view depicting in simplified form the configuration of a printer 10 in an alternative embodiment, shown with the upper chassis unit 30 closed. FIG. 13 is a sectional view depicting in simplified form the configuration of the printer 10 in the alternative embodiment, shown with the upper chassis unit 30 open. FIGS. 12 and 13 depict a cross section taken from the opposite side from the cross section shown in FIGS. 2 and 3. FIG. 14 is an illustration of the configuration around the printing mechanism section 50 of the printer 10 in the alternative embodiment.

As illustrated in FIGS. 12, 13, and 14, the delivery tube 340 connects the ink delivery section 330 with the carriage 80 of the printing mechanism section 50, and delivers the ink inside the ink packs 310 to the carriage 80. The delivery tube 340 is composed of successively connected sections, specifically, a section extending approximately on the horizontal (when the upper chassis unit 30 is closed) from the ink delivery section 330 in the direction of the rotation shaft 350 (hereinafter termed "first horizontal section H1"); a section situated in an approximately horizontal plane below the first horizontal section H1, and extending in a direction approximately orthogonal to the rotation shaft 350 (hereinafter termed "second horizontal section H2"); and a section approximately parallel to the rotation shaft 350 (hereinafter termed "third horizontal section H3").

Figure 15A:
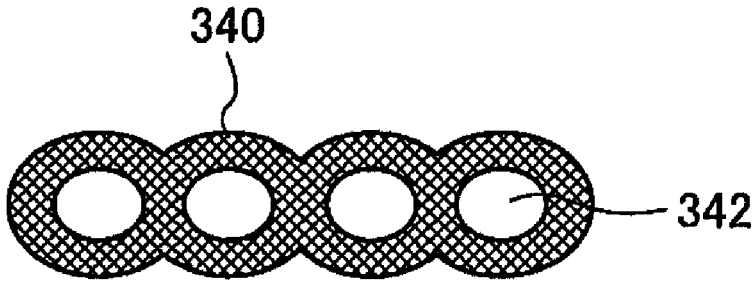
FIGS. 15A and 15B are sectional views depicting a cross section of a delivery tube.
Figure 15B:
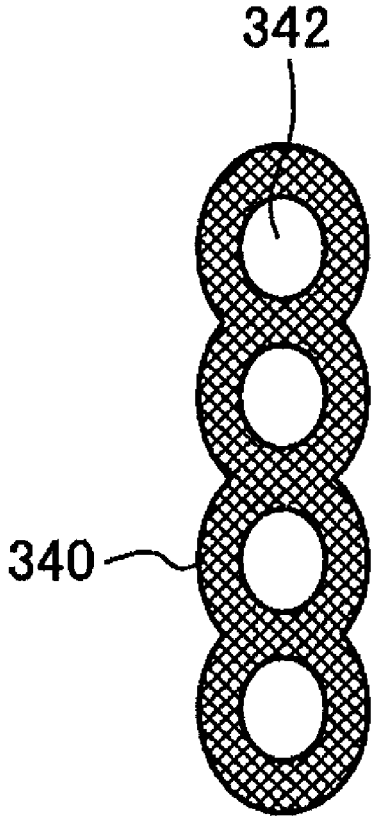

FIGS. 15A and 15B are sectional views depicting a cross section of the delivery tube 340. FIG. 15A shows a cross section of the delivery tube 340 taken perpendicular to the ink flow direction in the second horizontal section H2 (the cross section S1-S1 in FIG. 14); and FIG. 15B shows a cross section of the delivery tube 340 taken perpendicular to the ink flow direction in the third horizontal section H3 (the cross section S2-S2 in FIG. 14). As shown in FIGS. 15A and 15B, the delivery tube 340 is provided with four hollow ink passages 342 which correspond to the four ink packs 310. As shown in FIG. 15A, in the second horizontal section H2, the orientation of the delivery tube 340 about the ink flow direction is such that the four ink passages 342 line up in an approximately horizontal orientation (hereinafter also referred to as "sideways placement"). The delivery tube 340 in the first horizontal section H1 has similar orientation. Meanwhile, as shown in FIG. 15B, in the third horizontal section H3, the orientation of the delivery tube 340 about the ink flow direction is such that the four ink passages 342 line up in an approximately vertical orientation (hereinafter also referred to as "vertical placement").

Between the first horizontal section H1 and the second horizontal section H2 of the delivery tube 340 (in proximity to the rotation shaft 350) there is provided a section that bends along a vertical semicircular arc (hereinafter termed the "first bent section R1"). The first horizontal section H1 and the second horizontal section H2 both have sideways placement, so the first bent section R1 does not have twist. Between the second horizontal section H2 and the third horizontal section H3 there is provided a section that bends along a horizontal semicircular arc (hereinafter termed the "second bent section R2"). Because the second horizontal section H2 has sideways placement while the third horizontal section H3 has vertical placement, the second bent section R2 has twist of approximately 90 degrees. Between the third horizontal section H3 and the carriage 80 there is provided a section that curves along a horizontal semicircular arc (hereinafter termed the "third bent section R3").

As shown in FIGS. 12 and 13, in response to an operation to open the upper chassis unit 30, the delivery tube 340 will undergo deformation in the first bent section R1 which is situated in proximity to the rotation shaft 350. Thus, despite the relatively great length of the delivery tube 340 connecting the ink delivery section 330 with the printing mechanism section 50 in the printer 10, it will be possible to prevent the presence of the delivery tube 340 from interfering with opening and closing of the upper chassis unit 30.

The delivery tube 340 may also have a coupling 410 as depicted in FIGS. 12 and 13. The section of the delivery tube 340 situated towards the printing mechanism section 50 side of the coupling 410 may be formed of material of relatively high pliability (e.g. a polyethylene based elastomer). By so doing, it will be possible to easily form the first bent section R1 and the other non-linear sections of the delivery tube 340, as well as to impart good flexibility to the first bent section R1. The section of the delivery tube 340 situated towards the ink delivery section 330 side of the coupling 410 may be formed of material of relatively low pliability (e.g. polypropylene).

The delivery tube 340 is supported by support portions 420, 430 situated at two locations to either side of the second bent section R2. The support portions 420 and 430 are secured directly or indirectly to the main chassis unit of the printer 10. Thus, the delivery tube 340 is supported on the printer 10 via the support portions 420 and 430.

Figure 16A:
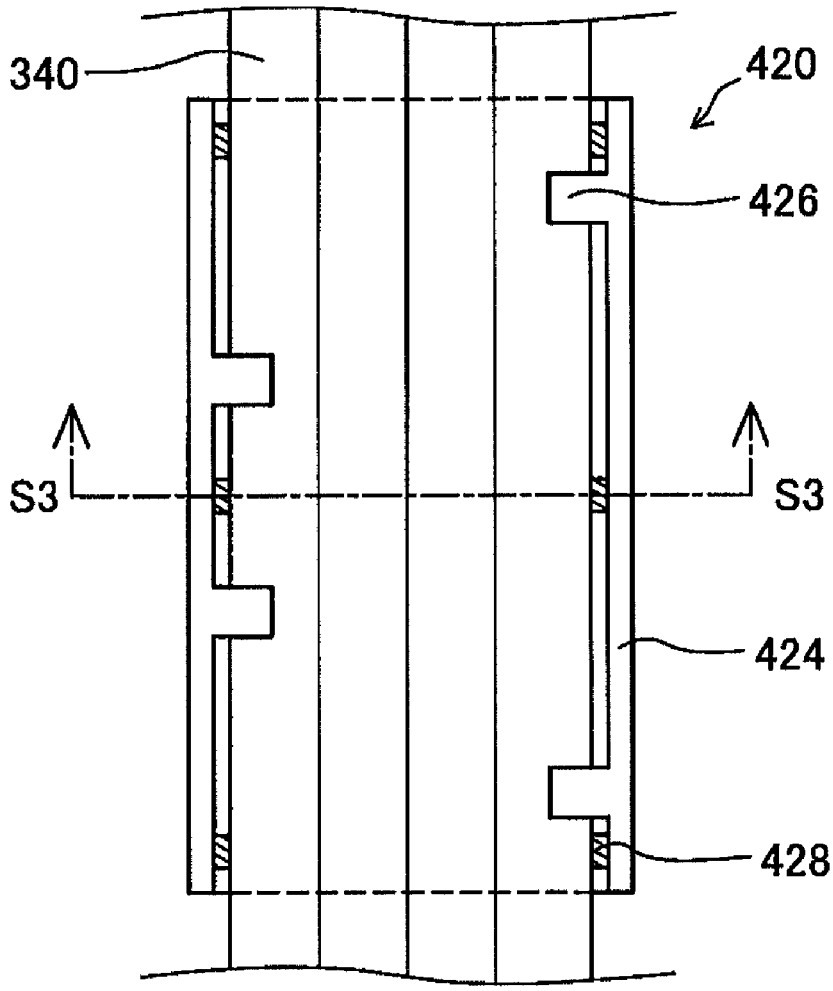
FIGS. 16A and 16B are illustrations depicting a configuration of a support portion in an alternative embodiment.
Figure 16B:
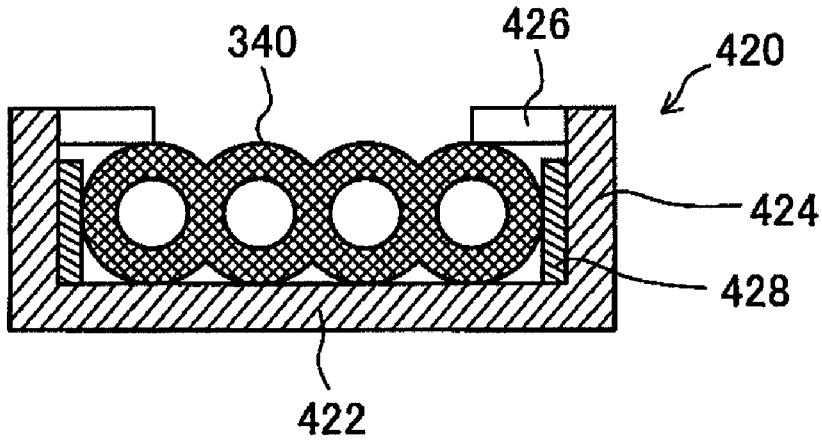

FIGS. 16A and 16B are illustrations depicting a configuration of the support portion 420 in the alternative embodiment. A top plan view of the support portion 420 is shown in FIG. 16A; and a cross section of the support portion 420 orthogonal to the ink flow direction (cross section S3-S3 in FIG. 16A) is shown in FIG. 16 B. As shown in FIG. 16B, the support portion 420 has a long side member 422 positioned in the horizontal direction; short side members 424 which project upward from either edge of the long side member 422 in cross section; and uplift restraining portions 426 which project inwardly in the horizontal direction from the upper edges of the short side members 424 in cross section. As shown in FIG. 16A, each one of the short side members 424 is provided with two of the uplift restraining portions 426 in mutually different arrangements such that the uplift restraining portions 426 disposed on the two short side members 424 will not be situated at the same location along the direction of ink flow. The long side member 422, the short side members 424, and the uplift restraining portions 426 together define a space of generally rectangular cross section housing the delivery tube 340, and the delivery tube 340 is accommodated within this space. The uplift restraining portions 426 prevent the delivery tube 340 from lifting up and becoming dislodged.

The support portion 420 additionally has positioning members 428 situated adjacently to the short side members 424 on the side thereof facing towards the aforementioned space. In the example of FIGS. 16A and 16B, three sets of positioning members 428 are provided, with the positioning members 428 of each set being positioned at mutually facing locations to either side of the delivery tube 340. Thus, the positioning members 428 have the effect of reducing the inside dimension between the two short side members 424. The positioning members 428 function to restrain the delivery tube 340 in the lengthwise direction and to inhibit movement of the delivery tube 340 along the ink flow direction. It is accordingly possible to prevent the delivery tube 340 from interfering with other parts of the printer 10.

As shown in FIGS. 15A and 15B, the ink passages 342 of the delivery tube 340 have cross section that is not circular but rather of elliptical shape elongated in the direction of array of the ink passages 342 (the left-right direction in FIG. 15A).

This is done, for example, to give the delivery tube 340 a cross section of linked ellipse shape and reduce the height of the delivery tube 340, in order to facilitate bending of the delivery tube 340 in the first bent section R1 and the second bent section R2 (see FIG. 14). Here, at locations where the positioning members 428 of the support portion 420 are situated, the delivery tube 340 is pressed by the positioning members 428 situated to either side thereby causing the cross section of the ink passages 342 to approximate circular shape and increasing the cross sectional area of the ink passages 342 as depicted in FIG. 16B. Consequently, flow passage resistance through the delivery tube 340 can be reduced.

The design of the support portion 430 (see FIG. 14) is similar to that of the support portion 420 shown in FIGS. 16A and 16B, but since it is possible to prevent movement of the delivery tube 340 with the support portion 420, it would be acceptable for the support portion 430 to lack the positioning members 428. Consistent with the orientation of the delivery tube 340, the support portion 430 will have an orientation equivalent to rotating the support portion 420 by about 90 degrees.

Since the support portions 420 and 430 are positioned at locations to either side of the second bent section R2 where displacement tends to occur due to twisting, it will be possible for the delivery tube 340 to be supported in a stable manner.

Figure 17A:
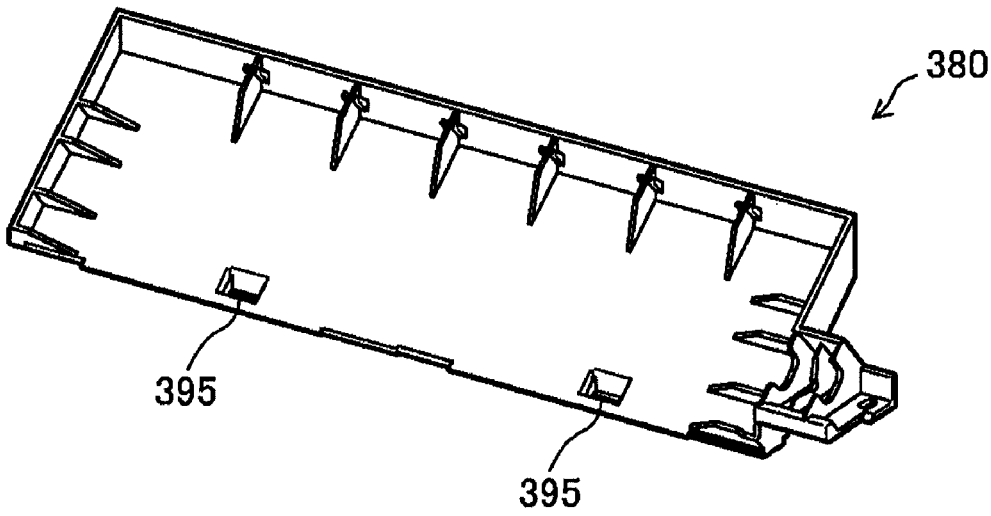
FIGS. 17A, 17B and 17C are illustrations depicting a joining structure for the holders and the lower housing in an alternative embodiment.
Figure 17B:
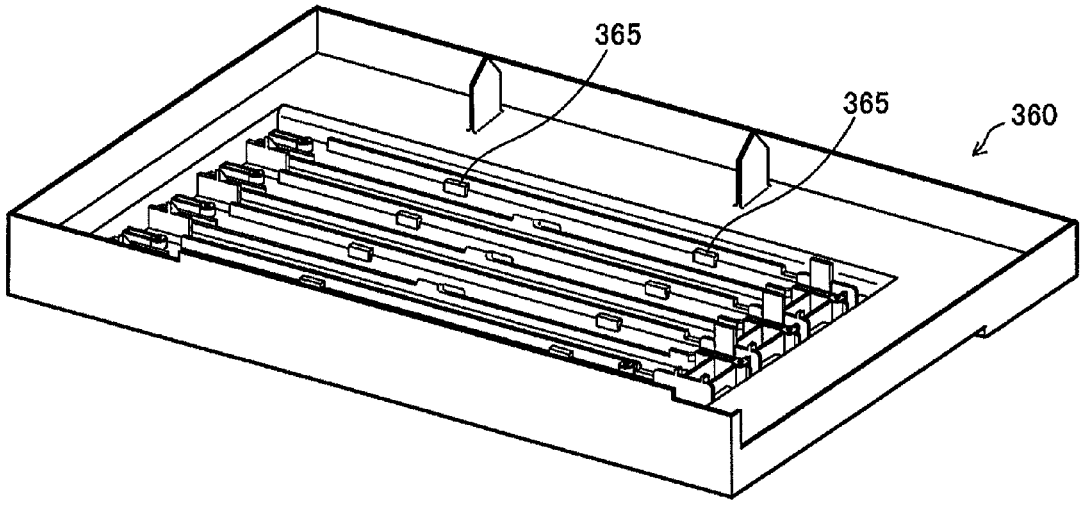
Figure 17C:
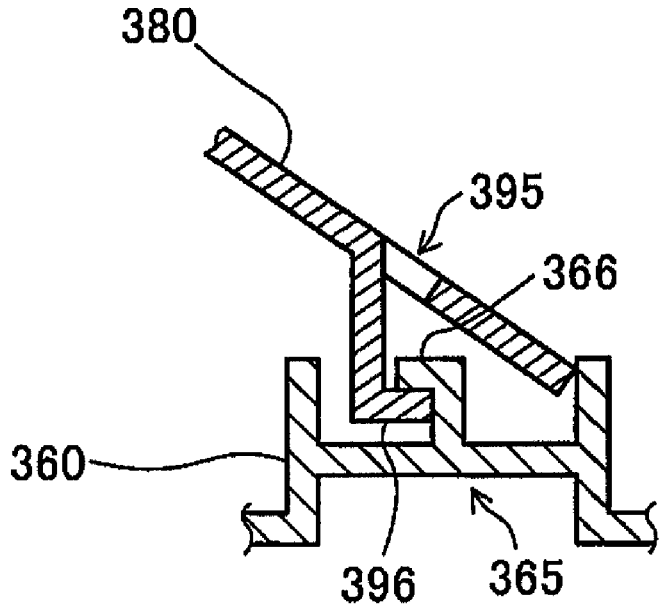

FIGS. 17A, 17B and 17C are illustrations depicting a joining structure for the holders 380 and the lower housing 360 in an alternative embodiment. FIG. 17A depicts a holder 380 in perspective view; FIG. 17B depicts the lower housing 360 in perspective view; and FIG. 17C depicts in cross section the joined sections of the holder 380 and the lower housing 360. As shown in FIG. 17A, the holder 380 has two joining portions 395. Meanwhile, as shown in FIG. 17B the lower housing 360 has two joining portions 365 situated at locations for installation of each of the holders 380. The holder 380 is installed in the lower housing 360 while sliding it in the sideways direction so that the joining portions 395 of the holder 380 mate with the joining portions 365 of the lower housing 360. As shown in FIG. 17C, with the holder 380 installed in the lower housing 360, an L-shaped portion 396 of the joining portion 395 of the holder 380 will mate with an L-shaped portion 366 of the joining portion 365 of the lower housing 360. This mating fit will prevent relative movement of the holder 380 and the lower housing 360. For this reason it will be possible to avoid separation of the holders 380 from the lower housing 360 even if the printer 10 is subjected to a shock, for example. It is also possible to avoid deformation of the holders 380 and the lower housing 360 due the effects of changes in ambient temperature or humidity outside.

Figure 18:
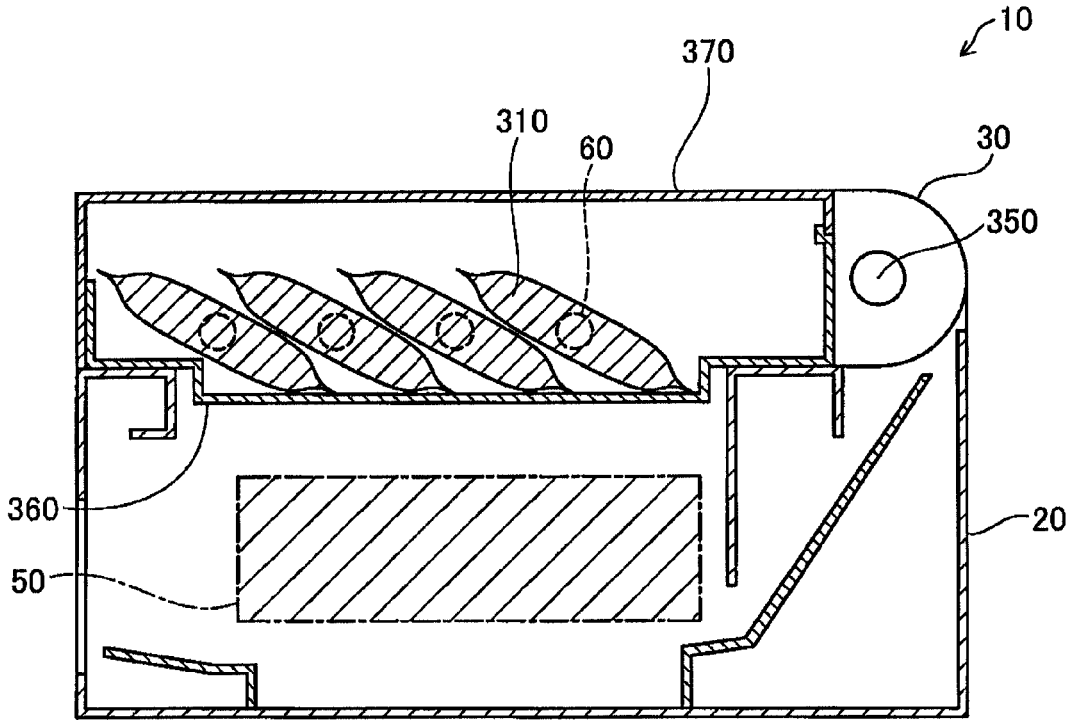
FIG. 18 is a sectional view depicting in simplified form a printer in an alternative embodiment, shown with the upper chassis unit closed.

FIG. 18 is a sectional view depicting in simplified form a printer 10 in an alternative embodiment, shown with the upper chassis unit 30 closed. In the embodiment illustrated in FIG. 18, the arrangement of the ink packs 310 differs from that in the embodiment shown in FIG. 2. Specifically, whereas the embodiment shown in FIG. 2 employs an arrangement wherein the ink packs 310 are positioned secured to holders 380 which are disposed in the upper chassis unit 30, the embodiment illustrated in FIG. 18 does not employ holders 380, instead employing an arrangement by which the ink packs 310 are positioned in stand-alone form within the upper chassis unit 30. In this way it is not always necessary to employ holders 380 for positioning the ink packs 310 within the upper chassis unit 30, and it would be possible for the ink packs 310 to rest directly within the upper chassis unit 30.

Figure 19:
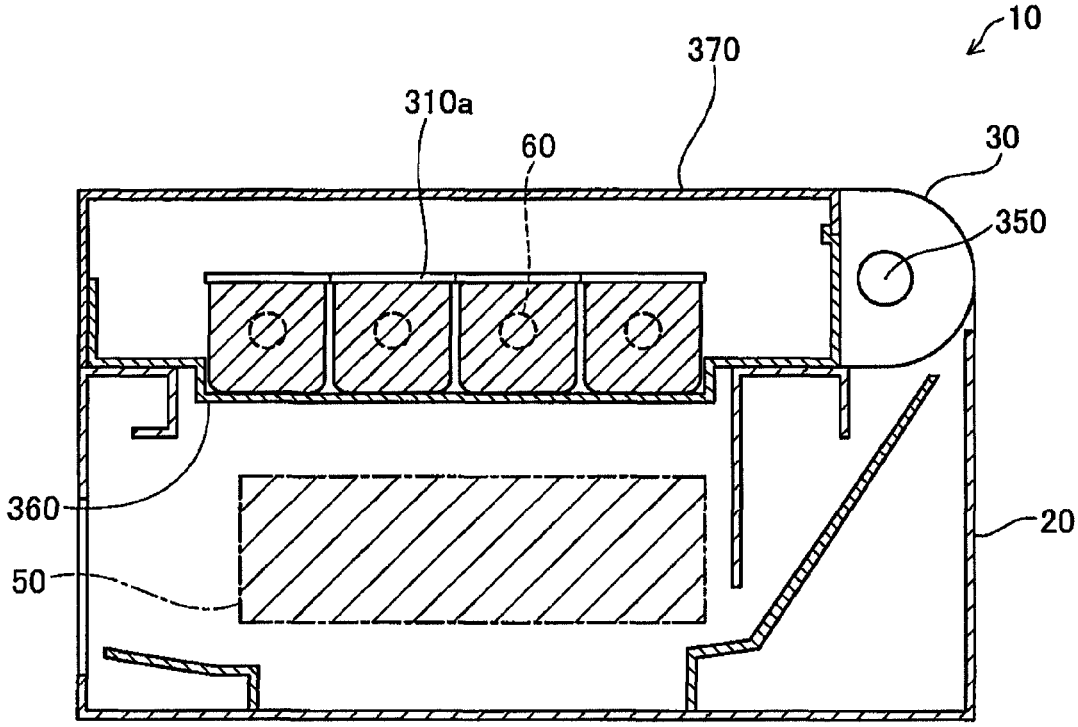
FIG. 19 is a sectional view depicting in simplified form a printer in an alternative embodiment, shown with the upper chassis unit closed.

FIG. 19 is a sectional view depicting in simplified form a printer 10 in an alternative embodiment, shown with the upper chassis unit 30 closed. In the embodiment illustrated in FIG. 19, the shape and arrangement of the ink packs differs from that in the embodiment shown in FIG. 2. Specifically, the embodiment illustrated in FIG. 19 employs ink packs 310*a* of cube shape, and as in the embodiment shown in FIG. 18, the ink packs 310*a* rest directly within the upper chassis unit 30. In this way, the shape of the ink packs is not limited to bag shape composed of flexible sheeting, and it is possible to employ other shapes such as a cube shape.

Figure 20:
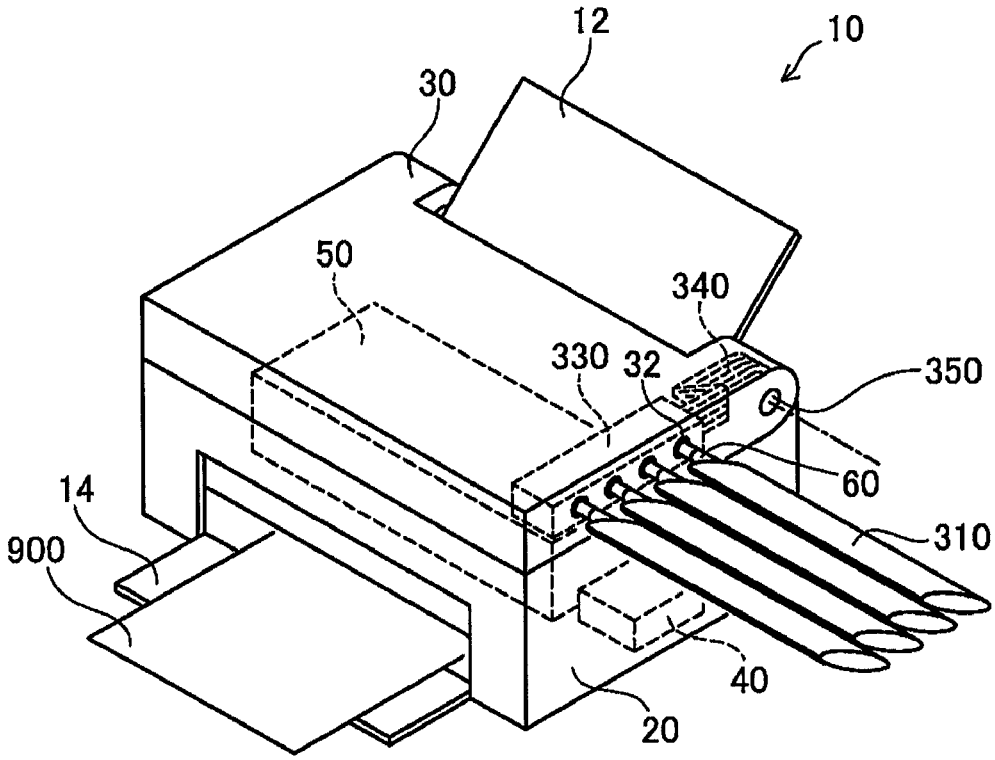
FIG. 20 is an illustration depicting in simplified form a printer in an alternative embodiment.

FIG. 20 is an illustration depicting in simplified form a printer 10 in an alternative embodiment. In the embodiment illustrated in FIG. 20, the arrangement of the ink packs 310 differs from that in the embodiment shown in FIG. 1. Specifically, in the embodiment illustrated in FIG. 20, the ink packs 310 are positioned to the outside of the printer 10 rather than being housed inside the upper chassis unit 30. In the embodiment illustrated in FIG. 20, the pack apertures 60 of the ink packs 310 are connected to the ink delivery section 330 via holes 32 provided in the upper chassis unit 30. In this way, the ink packs 310 need not always be housed inside the upper chassis unit 30, and may also be situated outside the printer 10.

Figure 21:
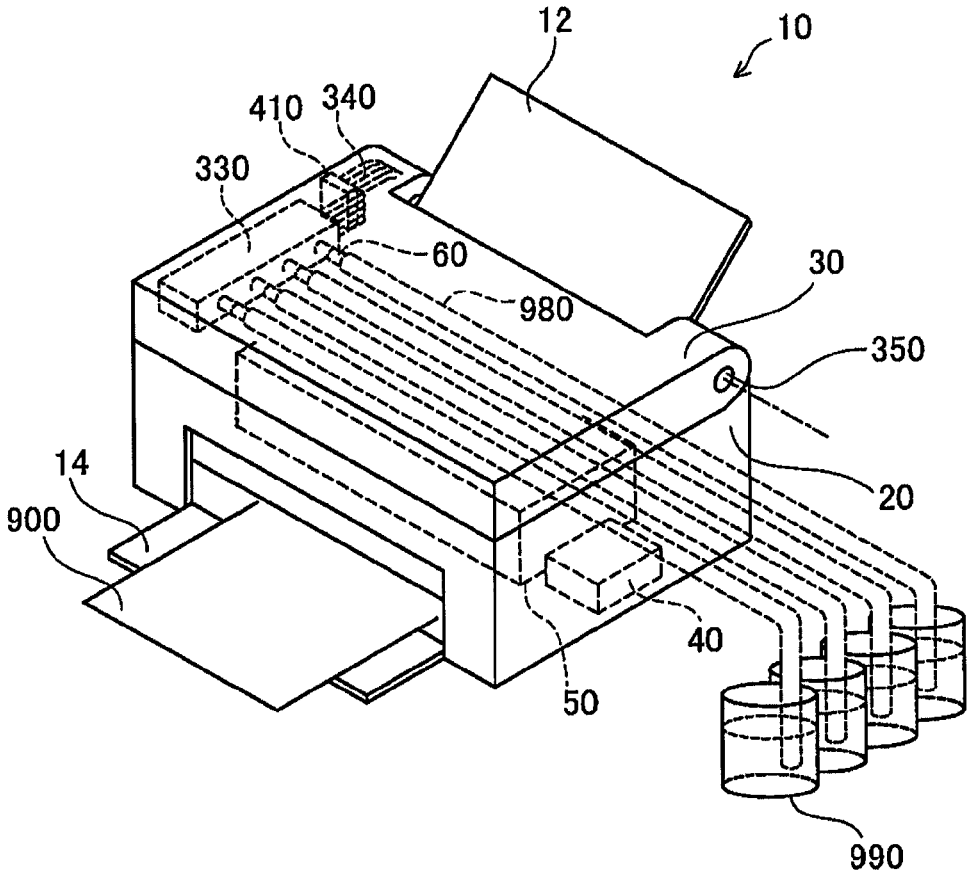
FIG. 21 is an illustration depicting in simplified form a printer in an alternative embodiment.

FIG. 21 is an illustration depicting in simplified form a printer 10 in an alternative embodiment. In the embodiment illustrated in FIG. 21, the ink delivery mode differs from that in the embodiment shown in FIG. 1. Specifically, in the embodiment illustrated in FIG. 21, the pack apertures 60 of the ink packs 310 are connected to the ink delivery section 330 (see FIG. 6), and tubes 980 are positioned between the pack apertures 60 and ink tanks 990 which contain ink. The ink in the ink tanks 990 is delivered to the printing mechanism section 50 via the tubes 980, the pack apertures 60, and the ink delivery section 330. The embodiment shown in FIG. 21 can be accomplished, for example, after the ink in the ink packs 310 has been used up, by removing the ink packs 310 leaving only the pack aperture 60, and installing the tubes 980 and the ink tanks 990.

According to the aspect of the invention, the plurality of holders may be arranged spaced apart along the inside base plane with an incline panel of one holder overlapping a fluid-containing pack resting on another holder. According to the above-mentioned fluid ejection device, the individual fluid-containing packs are respectively carried on the incline panels of the holders, thereby allowing the plurality of fluid-containing packs to be stacked and accommodated efficiently.

According to the aspect of the invention, the one holder may include: a back face reinforcing rib that descends along a fluid-containing pack resting on the another holder.

According to the aspect of the invention, the fluid ejection device may further comprise: a holder reinforcing rib that, disposed on the inside base plane, rises under an incline panel of a holder which is situated at the end of the arranged holders in a direction to which the incline panel inclines. According to the above-mentioned fluid ejection device, the holders can thereby be reinforced against force acting in the direction of the inclined panels.

According to the aspect of the invention, the fluid ejection device may further comprise: an end portion reinforcing rib that, disposed on an inside top plane of the container case, descends along a fluid-containing pack resting on a holder which is situated at the end of the arranged holders in an opposite direction to which the incline panel inclines. According to the above-mentioned fluid ejection device, it will be possible thereby to prevent excessive deformation of fluid-containing packs resting on holders which are situated on the opposite end from the side towards which the inclined panels incline.

According to the aspect of the invention, the fluid ejection device may further comprise: a medial reinforcing rib that, disposed on an inside top plane of the container case, descends along a zone at the fluid-containing pack resting on the another holder, wherein the zone lies between the one holder and the another holder. According to the above-mentioned fluid ejection device, it will be possible thereby to prevent excessive deformation of the upside of a fluid-containing pack unsupported by the back face of the inclined panel of an adjacent holder.

According to the aspect of the invention, the fluid ejection device may further comprise: a mating portion that, disposed on an inside top plane of the container case, mates with an upper edge of the incline panel of the holder, wherein the holder is fixed to the inside base plane. According to the above-mentioned fluid ejection device, it will be possible thereby to prevent excessive deformation of the holders.

Although the invention has been described and illustrated in detail, it is clearly understood that the same is by way of illustration and example only and is not to be taken by way of limitation, the spirit and scope of the invention being limited only by the terms of the appended claims.

What is claimed is:

1. A container case that houses a plurality of fluid-containing packs which contain a fluid for ejection by a fluid ejection device, comprising:

a plurality of holders that are disposed inside the container case individually, wherein each of the plurality of holders includes an incline panel that inclines toward an inside base plane of the container case, and each of the fluid-containing packs is individually attached on the corresponding incline panel.

2. The container case according to claim 1, wherein the plurality of holders are arranged spaced apart along the inside base plane with an incline panel of one holder overlapping a fluid-containing pack which is attached on an incline panel of another holder adjacent to the one holder.

3. The container case according to claim 2, wherein the one holder includes a back face reinforcing rib that descends along the fluid-containing pack which is attached on the incline panel of the another holder.

4. The container case according to claim 2, further comprising a medial reinforcing rib that, disposed on an inside top plane of the container case, descends along a zone at the fluid-containing pack which is attached on the incline panel of the another holder, wherein the zone lies between the one holder and the another holder.

5. The container case according to claim 1, further comprising a holder reinforcing rib that, disposed on the inside base plane, rises under an incline panel of a holder which is situated at the end of the arranged holders in a direction to which the incline panel inclines.

6. The container case according to claim 1, further comprising an end portion reinforcing rib that, disposed on an inside top plane of the container case, descends along a fluid-containing pack which is attached on an incline panel of a holder which is situated at the end of the arranged holders in an opposite direction to which the incline panel inclines.

7. The container case according to claim 1, further comprising a mating portion that, disposed on an inside top plane of the container case, mates with an upper edge of the incline panel of the holder, wherein the holder is fixed to the inside base plane.

8. The container case according to claim 1, wherein each of the plurality of holders contacts with the fluid-containing pack from below in a direction of gravity.

* * * * *